US011499683B2

(12) United States Patent
Teather et al.

(10) Patent No.: US 11,499,683 B2
(45) Date of Patent: Nov. 15, 2022

(54) MICRO-STRUCTURED OPTICAL SHEET AND PANEL LIGHT ASSEMBLY USING SAME

(71) Applicant: ABL IP Holding LLC, Atlanta, GA (US)

(72) Inventors: Eric W. Teather, Elkton, MD (US); Joel Mikael Petersen, Valley Village, CA (US); Robert Michael Ezell, Brunswick, OH (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 17/475,558

(22) Filed: Sep. 15, 2021

(65) Prior Publication Data

US 2022/0003364 A1 Jan. 6, 2022

Related U.S. Application Data

(63) Continuation of application No. 16/879,545, filed on May 20, 2020.

(Continued)

(51) Int. Cl.
*F21K 9/69* (2016.01)
*F21V 5/00* (2018.01)

(Continued)

(52) U.S. Cl.
CPC ..... *F21K 9/69* (2016.08); *F21V 5/004* (2013.01); *F21V 5/005* (2013.01); *F21V 5/045* (2013.01); *F21Y 2115/10* (2016.08)

(58) Field of Classification Search
None
See application file for complete search history.

(56) References Cited

U.S. PATENT DOCUMENTS

2008/0310171 A1* 12/2008 Hiraishi ..... G02B 5/0257 362/339
2009/0047486 A1* 2/2009 Jones ..... G02B 5/045 428/206

(Continued)

FOREIGN PATENT DOCUMENTS

JP 2007003852 1/2007
KR 100986782 10/2010

(Continued)

OTHER PUBLICATIONS

Application No. PCT/US2020/033862, International Search Report and Written Opinion, dated Aug. 26, 2020, 9 pages.

*Primary Examiner* — Ashok Patel
(74) *Attorney, Agent, or Firm* — Kilpatrick Townsend & Stockton LLP

(57) ABSTRACT

A luminaire includes a housing that defines a light output aperture, a backlight apparatus that emits light toward the light output aperture, and an optical sheet of light transmissive material. The optical sheet is adjacent the backlight apparatus and modifies the light before it leaves the light output aperture. The optical sheet forms a first surface and an opposite second surface. At least one of the first surface or the second surface of the optical sheet includes a first spatial region that includes elliptical diffusers oriented predominantly in a first direction, a second spatial region that includes elliptical diffusers oriented predominantly in a second direction that is different from the first direction, and a third spatial region that includes at least one type of optical microstructure selected from the group consisting of Fresnel lenses, v-groove lenses, v-cut lenses, pyramidal lenses, lenticular lenses, donut lenses and conical diffusers.

18 Claims, 11 Drawing Sheets

Related U.S. Application Data

(60) Provisional application No. 63/022,871, filed on May 11, 2020, provisional application No. 62/850,135, filed on May 20, 2019.

(51) Int. Cl.
*F21V 5/04* (2006.01)
*F21Y 115/10* (2016.01)

(56) References Cited

U.S. PATENT DOCUMENTS

| | | | | |
|---|---|---|---|---|
| 2010/0195314 | A1 | 8/2010 | Shinkai et al. | |
| 2013/0107543 | A1* | 5/2013 | Parker | G02B 6/0061 362/326 |
| 2017/0129272 | A1* | 5/2017 | Rich | B42D 25/378 |

FOREIGN PATENT DOCUMENTS

| | | |
|---|---|---|
| KR | 20110001524 | 1/2011 |
| WO | 2012059931 | 5/2012 |

* cited by examiner

MICRO-STRUCTURED OPTICAL SHEET AND PANEL LIGHT ASSEMBLY USING SAME

CROSS REFERENCE TO RELATED APPLICATIONS

This application is a continuation of U.S. application Ser. No. 16/879,545, filed May 20, 2020, which is a nonprovisional application of, and claims priority to, U.S. Provisional Patent Application No. 62/850,135, filed 20 May 2019, and U.S. Provisional Patent Application No. 63/022,871, filed 11 May 2020. The disclosures of the above-identified patent applications are incorporated by reference herein in their entireties for all purposes.

BACKGROUND OF THE INVENTION

The present application relates to optical structures that redirect light. Panel lights and direct-lit LED-based light fixtures typically include plastic sheets that diffuse light from light sources, such as light-emitting diodes (LEDs) in a uniform manner. Such sheets may be used alone, or in combination with other optical and/or structural elements.

SUMMARY OF THE INVENTION

This summary is provided as a general introduction to some of the embodiments described herein, and is not intended to be limiting. Additional example embodiments including variations and alternative configurations are provided herein.

"LED," as used herein, refers to a light emitting diode, which may be in bare chip form or packaged form. When LEDs are packaged, there may be one or more bare chips packaged with any type of protective structures and/or optics.

In one or more embodiments, a luminaire includes a housing that defines a light output aperture, a backlight apparatus that is configured to emit light in a light output direction toward the light output aperture, and a planar optical sheet of a light transmissive material. The planar optical sheet is disposed adjacent the backlight apparatus toward the light output direction, and is configured such that when the light passes therethrough, the light is modified by the planar optical sheet before leaving the luminaire. The optical sheet forms a first surface and an opposite second surface, and at least one of the first surface or the second surface of the optical sheet includes a plurality of spatial regions. A first four of the spatial regions are arranged to form an outer rectangle. Two of the first four of the spatial regions, on top and bottom sides of the outer rectangle, include elliptical diffusers that are oriented predominantly in a first direction that is transverse to the planar optical sheet, and the other two of the first four of the spatial regions, on left and right sides of the outer rectangle, include elliptical diffusers that are oriented predominantly in a second direction that is transverse to the planar optical sheet and is transverse to the first direction. A second four of the spatial regions are arranged to form an inner rectangle that is surrounded by the outer rectangle. Two of the second four of the spatial regions, on top and bottom sides of the inner rectangle, include elliptical diffusers that are oriented predominantly in the second direction, and the other two of the second four of the spatial regions, on left and right sides of the inner rectangle, include elliptical diffusers that are oriented predominantly in the first direction.

In one or more embodiments, a method of providing a three-dimensional (3D) appearance for a planar output surface of a luminaire includes providing a backlight apparatus that is configured to emit light toward a light output direction, and providing a planar optical sheet capable of modifying the light, as it propagates toward the light output direction. The optical sheet includes a plurality of first spatial regions that include elliptical diffusers oriented predominantly in a first direction, a plurality of second spatial regions that include elliptical diffusers oriented predominantly in a second direction, and one or more third spatial regions that include at least one type of optical microstructure selected from the group consisting of Fresnel lenses, v-groove lenses, v-cut lenses, pyramidal lenses, lenticular lenses, donut lenses and conical diffusers.

In one or more embodiments, a luminaire includes a housing that defines a light output aperture, a backlight apparatus that emits light toward the light output aperture, and an optical sheet of a light transmissive material. The optical sheet is disposed adjacent the backlight apparatus toward the light output direction, such that the light is modified by the optical sheet before leaving the light output aperture. The optical sheet forms a first surface and an opposite second surface. At least one of the first surface or the second surface of the optical sheet includes a first spatial region that includes elliptical diffusers oriented predominantly in a first direction, a second spatial region that includes elliptical diffusers oriented predominantly in a second direction that is different from the first direction, and a third spatial region that includes at least one type of optical microstructure selected from the group consisting of Fresnel lenses, v-groove lenses, v-cut lenses, pyramidal lenses, lenticular lenses, donut lenses and conical diffusers.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
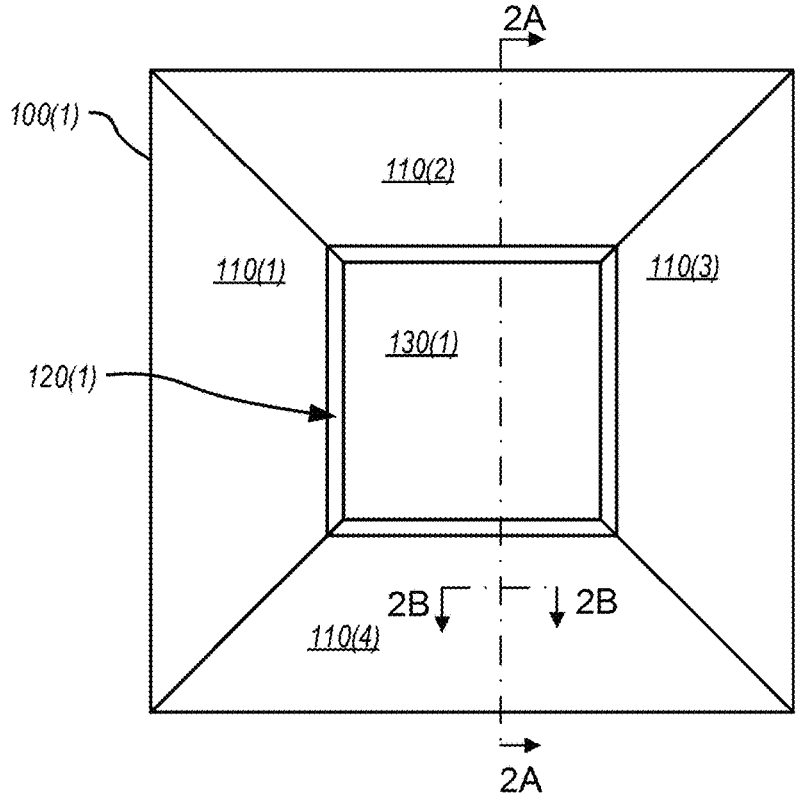
FIG. 1 schematically shows an exemplary optical sheet having an arrangement of elliptical diffuser spatial regions and prismatic lens micro-structure regions arranged to create a 3D visual effect for a luminaire, according to one or more embodiments.

The drawings represent an illustration of some of the embodiments of the present invention and are not to be construed as limiting the scope of the invention in any manner. Further, the drawings are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Specific instances of an item may be referred to by use of a first numeral followed by a second numeral within parentheses (e.g., optical sheets 100(1), 100(2), etc.) while numerals not followed by a second numeral within parentheses refer to any such item (e.g., optical sheets 100). In instances where multiple instances of an item are shown, only some of the instances may be labeled, for clarity of illustration.

Certain exemplary embodiments of the present invention are described herein and are illustrated in the accompanying drawings. The embodiments described are only for purposes of illustrating the present invention and should not be interpreted as limiting the scope of the invention. Other embodiments of the invention, and certain equivalents, modifications, combinations, and improvements of the described embodiments, will occur to those skilled in the art and all such alternate embodiments, equivalents, combinations, modifications, and improvements are within the scope of the present invention.

Certain embodiments herein relate to optical sheets that create three-dimensional ("3D") visual impressions through the use of light redirecting elements. The light redirecting elements may be arranged on a nominally flat optical sheet, to form regions with a collective appearance that simulates one or more 3D objects. Various ones of the regions can direct light into certain directions relative to the optical sheet and relative to one another, such that light intensity from the various regions changes when viewing angle with respect to the optical sheet changes. This can create the visual impression in the viewer that the regions are actually a three dimensional object, even though the regions are arranged in a simple flat plane, or at most a sheet that follows simple curves. The light redirecting elements may be micro-structures of varying shapes or orientations, and/or a combination of prismatic lenses with such structures, as explained below. The light redirecting elements and optical sheets disclosed herein are particularly adapted for use with panel lights and LED light assemblies.

Some of these embodiments, and others, are directed to optical sheets having a micro-structured pattern of varying shapes and/or orientations of light redirecting elements, and/or a combination of prismatic lenses with varying shaped/oriented light redirecting elements, particularly for use with panel lights and direct-lit LED light assemblies. An exemplary optical sheet may include an arrangement of one or more types of light redirecting elements and/or prismatic lenses. The arrangement may be configured to produce various visual effects including collimated light, diffuse light and/or combinations thereof. Specifically, an arrangement of light redirecting elements that are oriented at different angles with respect to one other can be used to create varying appearance when viewed from different viewing angles. Certain combinations of light redirecting elements and lenses (such as, but not limited to Fresnel lens structures) can be used to create a visual impression of depth, for example. An exemplary 3D optical sheet may have micro-structured pattern surface regions (e.g., regions having a distribution of light redirecting elements arranged thereon) that produce light emission angles that are different from one another, with the regions arranged in a pattern. The different light redirecting elements may include, but are not limited to, elliptical, conical, prismatic, v-groove, lenticular lens, and Fresnel structures; each such type of light redirecting element can cause light to be preferentially emitted from the optical sheet at one or more selected angles, or ranges of angles.

Light redirecting elements disclosed herein include two types of diffusers, which are referred to as "elliptical" or "conical" diffusers respectively. These elements selectively diffuse and/or redirect light over one or more angles or angular ranges as a function of their sizes, orientations, local density on an optical sheet, and/or mixture with other light redirecting elements.

"Elliptical" diffusers, as shown and discussed further below, typically act predominantly as small cylindrical lenses that either extend from, or are recessed within, an optical sheet. Physically, certain embodiments resemble "fibers" that are arranged in a relatively consistent axial direction on an optical sheet, with distal surfaces of the diffusers extending from the optical sheet and proximal surfaces of the diffusers merged with the sheet. However, these "fibers" are not completely uniform in direction or in circumference, they do not repeat at any fixed periodicity, and they do not typically lie atop the optical sheet, but rather merge with it. The distal surfaces are typically long in a predominant axial direction and curved in a transverse direction. Thus, the distal surfaces may approximate cylindrical lens profiles, and may refract light accordingly, that is, light entering an elliptical diffuser from the proximal surface (the optical sheet itself) and leaving through the distal surface will be spread by refraction transverse to the predominant axial direction of the diffuser. Elliptical diffusers will generally be substantially elongated in a predominant axial direction as compared to their cylindrical radius, usually in a ratio of at least 10:1, and often up to 100:1 or greater. However, elliptical diffusers are typically not purely cylindrical shapes; instead, they may and usually will vary in cross-section, radius of curvature, shape, direction and/or length, as shown and described below. These variations add an element of diffusion to the refractive spreading discussed above.

Because of the mechanical properties discussed above, elliptical diffusers are so named because of the effect that they provide on light passing through. The effect can be considered as transforming a collimated input beam to one that is dispersed into an elliptical output pattern. That is, the light passing through the sheet is refracted so as to expand the output beam significantly in a direction that is transverse to the dominant axial direction of the "fibers," but only minimally along the axial direction. Variations in diameter of the "fibers," as well as small deviations of the "fibers" from the dominant axial direction, expand the output beam somewhat along the axial direction itself. Thus an input light ray that would otherwise project to a single point will instead spread to project over an ellipse that is transverse to the original light ray direction of travel.

Controlling these physical features—diameters of the "fibers," point to point variations in these diameters, the "fibers'" dominant axial directions, and variations in these axial directions—allow control over the elliptical refraction characteristics. Films may be characterized and/or described by these characteristics. For example, a film that expands a collimated input beam that passes through the film, into an output beam that is 70 degrees wide (full width, half maximum) along the transverse direction and only 2 degrees wide along the dominant axial direction, may be characterized as, or called, a "70×2 elliptical film." Such a film would be a fairly extreme case of an elliptically diffusing film, in that the transverse beam expansion is much greater than the axial beam expansion. A film that provides about half as much expansion along the transverse direction, and about 2½ times the expansion along the axial direction, may be characterized as, or called, a "35×5 elliptical film." Useful angles of beam expansion cones for conical diffusers herein are often in the range of at least twenty degrees in the transverse direction and less than ten degrees in the axial direction, so that the effect is directional enough to trigger a viewer's impression that a viewed object is three-dimensional rather than a typical, symmetric diffuser.

One skilled in the art will also appreciate that elliptical diffusers may also be formed by cutting grooves, with physical features that cause the same refractive effects as discussed below, into an optical sheet. This is an example of elliptical diffusers not needing to be actually or even approximately cylindrical in shape; elliptical diffusers may have other curvatures or locally planar surfaces that spread light more in one direction than another. Many alternatives, equivalents and improvements will be readily conceived by the skilled practitioner upon reading and understanding the present disclosure, all of which are within the scope of this disclosure. For example, elliptical diffusers of asymmetrical (e.g., not cylindrical) cross-section may also be formed, and such diffusers may refract light into asymmetrical distributions.

"Conical" diffusers, also shown and discussed further below, typically resemble randomly distributed, nonperiodic, rounded shapes with little discernable axial direction. Distal surfaces of conical diffusers may be approximately hemispherical, teardrop shaped, conical, conical lenslets, or elliptical, but with a limited aspect ratio (up to about 3:1). Proximal surfaces of the conical diffusers merge with an optical sheet on which they are located. Light entering a conical diffuser from the proximal surface (e.g., the optical sheet itself) and leaving through the distal surface is generally scattered in many directions, and for light entering an optical sheet at any incidence angle, much of the light may be deviated from that incidence angle.

Because of the mechanical properties discussed above, conical diffusers are so named because of the effect that they provide on light passing through. The effect can be considered as transforming a collimated input beam to one that is dispersed into a conical output pattern. That is, the light passing through the sheet is refracted so as to expand the output beam significantly in all directions that are transverse to the initial direction of the beam. Controlling sizes and shapes of conical diffuser features can be used to control the degree of output beam expansion (e.g., a half angle of an output cone of light) relative to the input beam. Conical diffuser films may be characterized and described by the effect on the input beam. For example, a film that expands a collimated input beam that passes through the film, into an output beam that can be considered a dispersion cone, 30 degrees wide (full width, half maximum) may be called a 30 degree conical film.

Thus, areas of an optical sheet having a high density of conical diffusers will tend to cast light into many angles, and may thus obscure a point of origin of the light. This makes areas of conical diffusers useful in that when small, high output LEDs are used, their light will be spread over a large area, and the unpleasant experience of a viewer seeing the light as coming from very bright point sources can be mitigated.

Elliptical diffusers, conical diffusers and other diffusers herein may have a multi-lens outer surface, such as a curved outer surface, and may be in the shape of a dome, or bead.

Prismatic lenses, or simply lens or lenses, as used herein, include lenses with planar surfaces in at least one local direction, including Fresnel lenses. For example, a Fresnel lens that is laid out as a set of curved lines in plan view, but with spaces between each pair of curved lines forming a locally planar surface from one line to other of the pair, would be considered one form of a prismatic lens. Prismatic lenses may also be linear or two axis prisms. Prismatic, v-groove, v-cut, pyramidal, lenticular, and/or Fresnel lenses are examples of lenses that direct light at least primarily into one or two preferred directions from a planar surface of an optical sheet to produce directed light, which may include collimated light, which light may be emitted at a single angle, or different angles, including asymmetrically.

An exemplary optical sheet is macroscopically flat, that is, the optical sheet forms a planar surface within a small tolerance such as 1 millimeter measured normal to the planar surface. Microscopically, the optical sheet is patterned with micro-structured light redirecting elements such as those discussed above, and may optionally include further features such as diffusers and/or lenses, distributed over various regions of the optical sheet. In an exemplary embodiment, a first region of the optical sheet is configured with a light redirecting element of a first type and/or orientation, and a second region is configured with a different type or orientation of light redirecting element, to form a pattern. For example, a first region of the optical sheet may have a first type of light redirecting element and a second region may be configured with a second type of light redirecting element to form a pattern. The second orientation may be ninety degrees different from the first orientation, but other differences between orientations are possible. A first region of the optical sheet surface may have a first type of diffuser and a second region may have a second type of diffuser. A first region of the optical sheet surface may have a first type of diffuser that is oriented in a first direction and a second region may have the same type of diffuser that is oriented in a second direction or orientation to produce a pattern. In many cases, multiple regions are configured with light redirecting elements in a first orientation, and other multiple regions are configured with a similar type of light redirecting elements, but in a second orientation. A first region of the optical sheet surface may have a first type of lens and a second region may have a second type of lens. A first region of the optical sheet surface may have a first type of lens that is oriented in a first direction and a second region may have the same type of lens that is oriented in a second direction or orientation to produce a pattern. A first region of the optical sheet surface may be configured with one or more diffusers, and a second region may be configured with one or more lenses. Regions configured with different ones and/or mixtures of the diffusers and lenses are also possible. An optical sheet designer who reads and comprehends the present disclosure will readily conceive further combinations, improvements, equivalents and alternatives to the specific examples provided above, all of which are within the scope of this disclosure.

Examples of patterns that can be formed using the features and modalities described herein include, without limitation, any type of image or design that would lend itself to a lit surface with a visual impression of depth. These include picture frames, simulations of existing luminaire types (e.g., center basket luminaires and others), geometrical patterns, logos, trademark symbols, text letters, words, images, real or imagined topography, abstract designs, and the like. Examples created during development include a center-basket luminaire image, a picture frame, a picture frame made from quadrants, and a pyramid, as well as numerous abstract designs using micro lenses in combinations. Interior and/or outer portions of an optical sheet may include regions having one type of light redirecting element, prismatic lens or diffuser, and another region or area with the opposing type of light redirecting element. In one exemplary embodiment, one type of light redirecting element is configured in a polygonal region of the sheet, such as a square, rectangle, pentagon or any other multi-sided region. In a further exemplary embodiment, one type of light redirecting element is configured in a perimeter region surrounding another type of light redirecting element. In a further exemplary embodiment, one type of light redirecting element is configured in a circular or oval region of the optical sheet. In a further exemplary embodiment, one type of light redirecting element in configured in an arc shaped region of the optical sheet. In a still further exemplary embodiment, one or more types of light redirecting elements are configured in regions that form a letter, numeral, symbol or other text.

The light redirecting elements discussed above, for example, diffusers and micro lenses having a height of no more than 1000 microns and preferably no more than 500 microns from an optical sheet surface, may be arranged to form a micro-structured pattern on the optical sheet surface. The micro-structured pattern in the surface of the optical sheet may be an additive relief pattern, wherein the light altering elements, diffusers and lenses, extend upwards (e.g., away) from a reference surface of the optical sheet. For example, a reference surface may be a local plane at a height of the lowest part of all features of the additive relief pattern, (notwithstanding that the optical sheet may be curved or otherwise formed on a scale far exceeding that of the light altering elements). Exemplary micro diffusers may include a combination of holographically originated random elliptical and conical diffusers that may be obtained from Wave-Front Technology (Paramount, Calif.) having a height of 3 to 20 microns and a radius of curvature of 1 to 50 microns. These and other micro diffusers and micro lenses may be micro-structures added to the reference surface (or cut into the surface, as discussed below). Such structures may be characterized as having dimensions such as height, diameter, width, and/or depth of no more than about 1,000 microns, no more than about 500 microns, no more than about 250 microns, no more than about 100 microns, no more than about 50 microns, and any range between and including the dimensions provided, including between 1 and 500 microns; from the reference surface of the optical sheet. However, axial dimensions (e.g., length) of elliptical diffusers are excluded from these ranges as they may be many times the height, diameter, width, and/or depth of these structures, as discussed above.

Alternatively, light altering elements may be cuts or indentations into a reference surface of the optical sheet. For example, an exemplary lens may be formed by a prismatic groove having a 3 to 20 micron height and 5 to 100 micron width, with symmetric and/or asymmetric angles.

The height and radius ranges above should be understood as generally applying to height and/or depth of features relative to a background surface of an optical sheet. That is, prismatic lenses and some diffusers, such as elliptical diffusers and/or bead diffusers, and grooves that extend across an optical sheet, may have lengths greater than these dimensions. Such features may be as long or wide as an optical sheet, or even longer/wider given that they may form curved shapes within the optical sheet.

When an exemplary optical sheet as disclosed herein is used within a light assembly having a light guide, the light guide may include extraction features in a pattern that can be varied to create a light intensity pattern that complements the optical sheet, to create additional depth. For example, an extraction dot pattern may be eliminated in portions of the light guide that are adjacent to specific contrast lines in the optical sheet, or the extraction dot pattern may be made dense adjacent to portions of the optical sheet that produce bright lines and/or areas. Light guides used herein are typically planar to facilitate containing light by total internal reflection except when the light encounters extraction features that scatter the light out of the light guide, but nonplanar light guides are also possible.

An exemplary light assembly, having a light guide, a back reflector, and an optical sheet as disclosed herein, can be further modified to create and/or enhance 3D imagery to create additional perceived depth. For example, the back reflector may be modified to have a pattern configured therein through painting, screen-printing, UV printing and/or adhesive laminating a pattern. One example was made wherein a white pattern was UV printed onto Miro 4 specular highly reflective metal (which may be obtained from Alanod, Ennepetal Germany) to complement the front diffuser pattern.

Figure 2A:
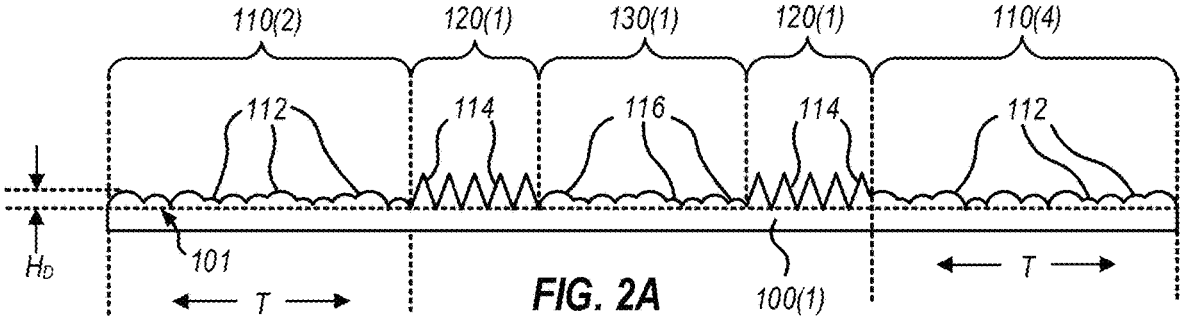
FIG. 2A schematically illustrates, a cross-sectional view, a diffuser micro-structure on an outer surface of the optical sheet of FIG. 1.
Figure 2B:
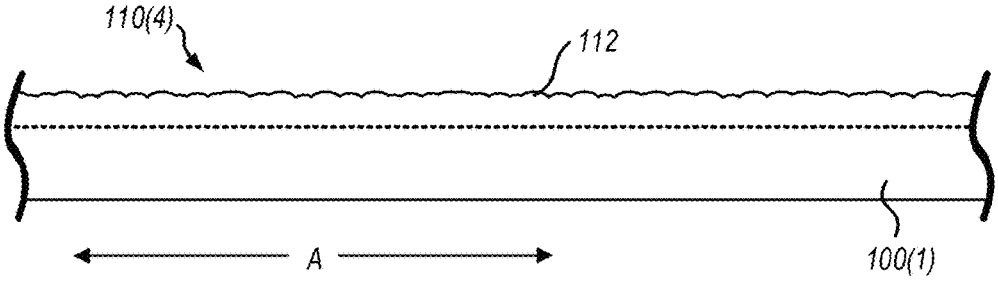
FIG. 2B schematically illustrates, a cross-sectional view, surface texture of an individual elliptical diffuser within one spatial region of the optical sheet of FIG. 1.

Referring now to FIGS. 1, 2A and 2B, an exemplary optical sheet 100(1) includes elliptical diffuser spatial regions 110 and prismatic lens micro-structure regions arranged to create a 3D visual effect for a luminaire. Optical sheet 100(1) may for example form part of an optical cover that modifies light emitted from a backlight apparatus, as it passes toward a light output direction of a luminaire (see, for example, FIGS. 3 and 4). The arrangement shown in FIG. 1 is a simple picture frame design, having elliptical diffusers in four spatial regions 110(1), 110(2), 110(3) and 110(4) that form an outer square around a perimeter formed of prismatic lenses, and a center, or inner square, spatial region 130(1) of conical diffusers. Arrangements of spatial regions with straight inner and outer sides, and mitered corners (e.g., corners that meet at angles) that collectively define a rectangular (including square) outer perimeter and a rectangular (including square) inner perimeter, are sometimes called frame regions herein.

Because the illustrated arrangement is square, spatial regions 110(1) through 110(4) are sometimes referred to as quadrants herein. Although optical sheet 100(1) is square, optical sheets herein may be of any shape suitable for use with a luminaire; square, rectangular, and rounded shapes (circular, elliptical, ovoid and the like) are the most common shapes; these and any other shapes that can be covered with a planar or curved planar optical sheet 100 are contemplated. Also, spatial regions that form an outer boundary corresponding to a given shape may be referred to herein as having or forming that shape, although they may not fill the shape. For example, spatial regions 110(1), 110(2), 110(3) and 110(4) are said to form a square, outer square, rectangle or outer rectangle, even though those spatial regions do not fill the portion of optical sheet 100(1) that is occupied by perimeter spatial region 120(1) and central spatial region 130(1). Perimeter spatial region 120(1), and central spatial region 130(1), are likewise central rectangles, inner rectangles, central squares or inner squares within the outer square. Furthermore, although spatial regions 110(1), 110(2), 110(3) and 110(4) are uniform in width (distance from the outer square edge to the inner edge of each spatial region) spatial regions that form asymmetric frame-like features are also contemplated (e.g., frames with wider side borders than top and bottom borders, vice versa, and the like).

The illustrated arrangement of elliptical diffusers and prismatic lenses produces light emission from optical sheet 100 that creates an impression of depth, even though optical sheet 100 is planar as installed. Orientation of the elliptical diffusers in each spatial region 110 is such that the diffusers in adjacent regions are at different angles to one another; in this case, spatial regions 110(1) and 110(3) have diffusers that are predominantly left-to-right in the perspective of FIG. 1, while spatial regions 110(2) and 110(4) have diffusers that are predominantly top-to-bottom. Because the diffusers in the different spatial regions will scatter light differently, this arrangement creates different light intensities in each of the quadrants, based on viewing angle, which creates a visual impression of depth and contrast among the quadrants. For example, as shown in FIGS. 1 and 2A, elliptical diffuser spatial regions 110 may be configured around a prismatic lens portion 120(1), such as a Fresnel lens border that extends around centrally located spatial region 130(1) of optical sheet 100. Lines 2A-2A and 2B-2B indicate cross-sectional views that are illustrated in FIGS. 2A and 2B respectively.

FIG. 2A schematically illustrates, in a cross-section that is not drawn to scale, a diffuser micro-structure on an outer surface of optical sheet 100. The microstructure includes a combination of elliptical diffusers 112 in spatial regions 110, prismatic lens structures 114 in spatial regions 120(1) and conical diffusers 116 in spatial region 130(1) (only representative ones of elliptical diffusers 112, prismatic lens structures 114, and conical diffusers 116 are labeled, for clarity of illustration). A transverse direction T is labeled for spatial regions 110(2) and 110(4) in FIG. 2A, this direction is transverse to the predominant orientation of elliptical diffusers 112. That is, since elliptical diffusers 112 act substantially like cylindrical lenses, direction T is transverse to the cylindrical axes of individual elliptical diffusers 112. An axial direction A is perpendicular to the plane illustrated in FIG. 2A. It should be understood that directions T and A are specific to individual spatial regions, because they indicate directions transverse and axial to the diffusers in such regions; directions T and A can and usually are different for different spatial regions of an optical sheet 100. Also, spatial region 130(1) does not have a transverse or axial direction because conical diffusers 116 associated therewith provide scattering that does not have directionality such as imparted by elliptical diffusers 112. Prismatic lens structures 114 may, or may not, impart a light redirection having an orientation that is consistent across spatial region 120(1).

Diffusers 112 and 116, and prismatic lens structures 114, are examples of micro-structures coupled with the optical sheet surface. Diffusers 112 and 116 have a maximum diffuser height HD of no more than about 1,000 microns relative to a reference plane 101 of optical sheet 100. Reference plane 101 is a planar surface that would be present if no microstructures were added to, or embossed or cut into, optical sheet 100, and is shown for discussion purposes, but is not a physical structure. As shown below in FIG. 2C, elliptical diffusers 112 can resemble "fibers" on top of, and merged with, reference plane 101. In FIG. 2A, cylindrical radii of elliptical diffusers 112 (e.g., height HD of elliptical diffusers 112) range from about one micron to about 5-7 microns, but these sizes are exemplary only; cylindrical radii of up to about 1000 microns will perform substantially similarly. (Above about 500 microns in radius, individual "fibers" may start to become undesirably visible to a viewer.)

FIG. 2B illustrates, in a cross-sectional view that is also not drawn to scale, optical sheet 100(1). The illustrated texture imparts some—but not a great deal of—diffusion along the labeled axial direction A of elliptical diffusers 112 (axial direction A is orthogonal to transverse direction T, which is perpendicular to the plane illustrated in FIG. 2B).

Figure 2C:
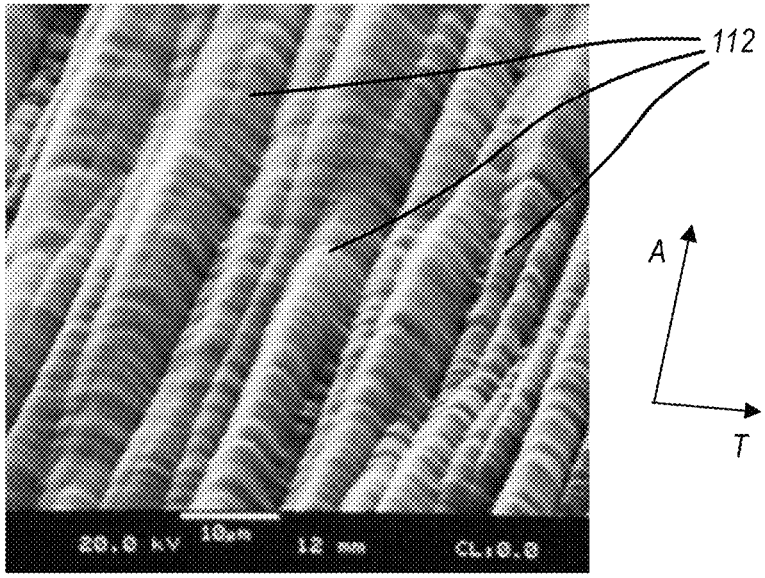
FIG. 2C is an electron microscope photograph, taken in a perspective view, of exemplary elliptical diffusers 112, according to one or more embodiments.
Figure 2D:
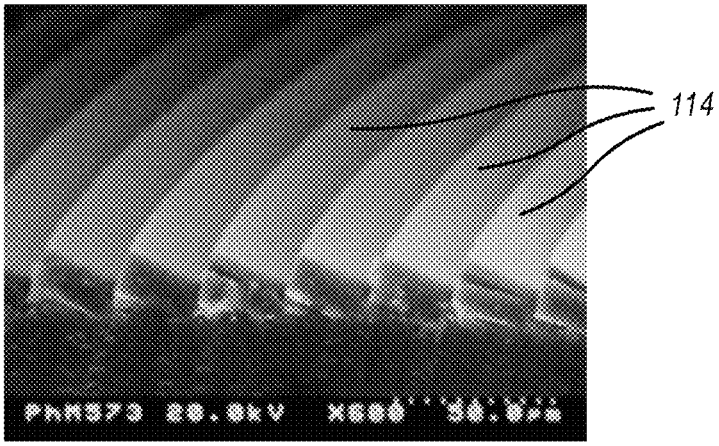
FIG. 2D is an electron microscope photograph, taken in a perspective view, of exemplary prismatic lens structures, according to one or more embodiments.
Figure 2E:
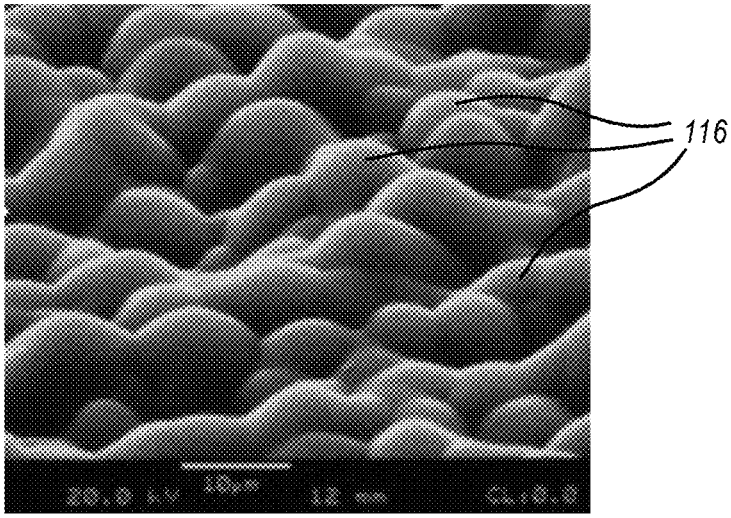
FIG. 2E is an electron microscope photograph, taken in a perspective view, of exemplary conical diffusers, according to one or more embodiments.

FIGS. 2C, 2D and 2E are electron microscope photographs, taken in perspective views, of exemplary elliptical diffusers 112, prismatic lens structures 114 and conical diffusers 116 respectively.

Axial direction A and transverse direction T, which are relevant to elliptical diffusers 112, are labeled in FIG. 2C. As will be appreciated by one skilled in the art upon reviewing and understanding FIG. 2C, elliptical diffusers 112 provide strong redirection of light passing through, in the transverse direction T, because they approximate cylindrical lenses with axes aligned in axial direction A. Elliptical diffusers 112 also have small variations in size along axial direction A; these variations provide a small amount of light scattering along axial direction A. By adjusting the sizes of elliptical diffusers 112 and the small variations in size along axial direction A, one skilled in the art can make spatial regions populated with elliptical diffusers 112 to create various elliptical dispersions as desired, such as the 70×2 and 35×5 elliptical films discussed above.

Prismatic lens structures 114, examples of which are illustrated in FIG. 2D, may or may not have a predominant (e.g., fixed) axial direction. For example, the structures shown in FIG. 2D curve, so in this particular example there is no identifiable axial direction. However, in other embodiments, prismatic lens structures may be linear or two axis prisms. And, although there is not an axial direction, one skilled in the art will be able to provide prismatic shapes of prismatic lens structures 114 that direct light in one or more desired directions by refraction through the known angles of structures 114.

As seen in FIG. 2E, conical diffusers 116 can resemble random, rounded "bubbles" on top of, and merged with, the underlying reference surface. The random distribution of the "bubbles" imparts diffusion to light passing through that can be characterized as a cone of output light for every beam of input light. Size of the "bubbles" and angles formed where they adjoin, can be used to vary the size of the dispersion cone for light passing therethrough. Thus, microstructure sizes can vary and an angle subtended by a dispersion cone of light passing therethrough can be predicted from the sizes and actual angles formed by the structures. Useful angles of dispersion cones for conical diffusers herein are often in the range of twenty to forty degrees.

Figure 3:
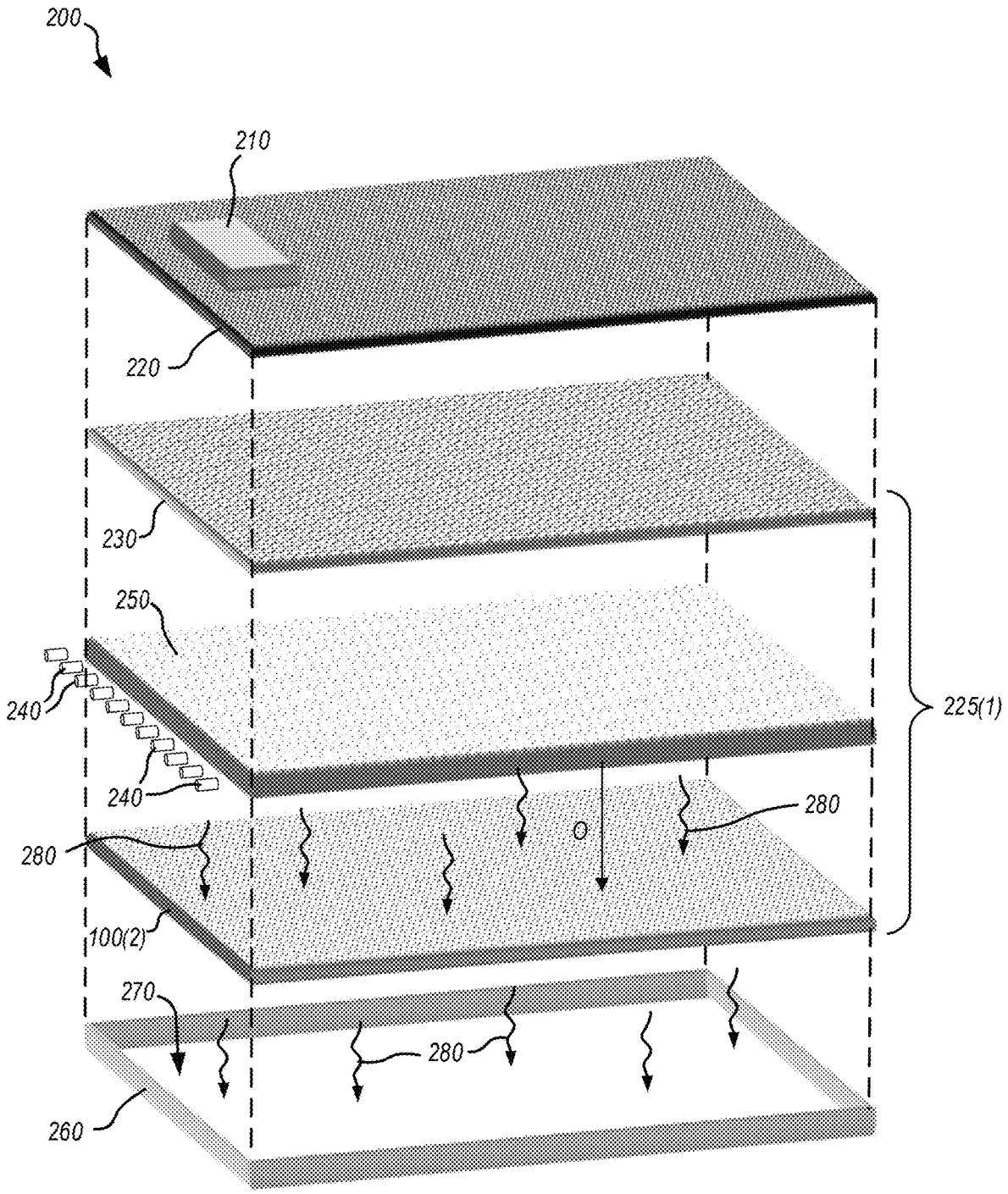
FIG. 3 schematically illustrates, in a perspective exploded view, a luminaire in the form of a panel light assembly, according to one or more embodiments.

FIG. 3 schematically illustrates, in a perspective exploded view, a luminaire 200 in the form of a panel light assembly, having an electronics assembly 210, a back plate 220, an optional reflector 230, light sources 240, an edge-lit, planar light guide 250 and an exemplary optical sheet 100(2) having a combination of prismatic lenses and diffusers. Luminaire 200 may include a housing 260 to provide mechanical support for the components of luminaire 200; housing 260 forms a light output aperture 270 through which luminaire 200 is configured to emit light 280. Although FIG. 3 is not drawn to any particular scale, optical sheet 100(2) is an example of a rectangular optical sheet.

Light sources 240, light guide 250, optional reflector 230 and optical sheet 100(2) depicted in FIG. 3 may be referred to as an optical subassembly 225(1). In the illustrated embodiment, luminaire 200 and optical subassembly 225(1) include LEDs as light sources 240. Light sources 240 may be arranged within one or more sides of housing 260, and configured to emit light into light guide 250. Light guide 250 may have micro-structures sometimes called "extraction features" herein, that produce different regions of light with controlled intensities, by disrupting total internal reflection of light 280 within light guide 250 (see FIG. 4A). For example, density or shape of the extraction features can change from area to area of light guide 250, in order to affect the net amount, average direction, and/or directional or diffuse quality of light extracted thereby. Together, light sources 240 and light guide 250 act as a backlight apparatus to emit light toward output aperture 270, but other types of backlight apparatus (e.g., using downwardly-emitting light sources such as arrays of LEDs, fluorescent and/or incandescent lighting, or even natural light) are possible (see FIG. 4B).

Optional reflector 230 may be used to capture any light that is scattered out of light guide 250 away from the light output direction and redirect that light toward output aperture 270. Reflector 230 may also have one or more patterns thereon, to further affect the amount, average direction, and directional or diffuse quality of light reflected therefrom. For example, when present, reflector 230 may have some spatial areas of specular reflection and other spatial areas of diffuse reflection, and the diffusion provided in such areas can vary. Areas of specular reflection will cause light extracted from the light guide to reflect back from the reflector at its angle of incidence. Depending on the type of extraction feature that directs some light toward reflector 230 (see FIG. 4A) and because light guide 250 is typically lit from the edges, this angle may be low in reference to the surface of the light guide. For portions of a reflector 230 that have roughening, diffuse substances applied, and/or the like, there can be more scattering of light into both higher and lower angles. Patterning of reflectors 230 with contrasting areas of diffuse and specular reflection can be used to create areas of light contrast in conjunction with a light guide 250, and can be used in conjunction with optical sheets 100 herein to create and/or enhance contrast and the visual impression of 3D effects. Other embodiments of luminaires 200 and/or optical subassemblies 225 may not utilize a reflector 230 (see, e.g., FIG. 4B).

Figure 4A:
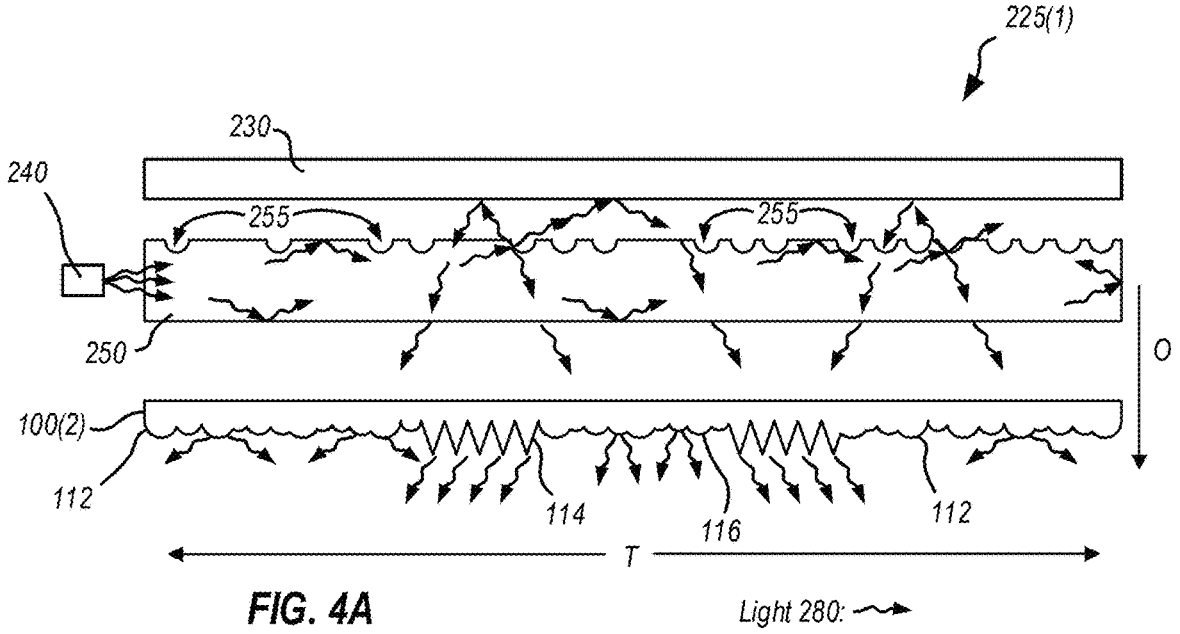
FIG. 4A schematically illustrates, in a cross-sectional view, optical structures of an optical subassembly shown in FIG. 3.
Figure 4B:
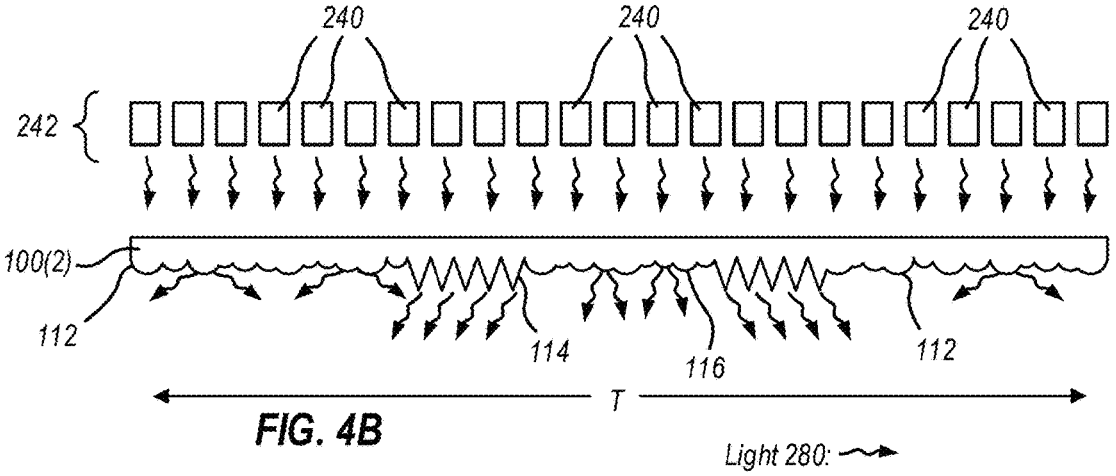
FIG. 4B schematically illustrates, in a cross-sectional view, optical structures of an alternate optical subassembly, according to one or more embodiments.

In the orientations of FIGS. 3, 4A and 4B, the upward direction is toward the "back" of the light assembly and the downward direction is the "front," that is, the back-to-front direction is an output light direction O for the luminaire. More specifically, a direction from the backlight apparatus toward an optical sheet 100 is defined as output light direction O. Housing 260 can be used to support and stabilize the elements shown with respect to one another, and further mechanical components, mounting hardware, and the like, may be present when luminaire 200 is fully assembled. Typically, luminaire 200 will include a back plate 220; an electronics assembly 210 can include AC/DC and voltage converters, drivers, wireless interface gear and the like, and can be mounted on back plate 220. The light is emitted from light sources 240 (which, again, can be but are not limited to LEDs) into light guide 250. Light guide 250 distributes the emitted light over the full surface of luminaire 200, that is, across optical sheet 100(2) enroute to output aperture 270. Light extraction features and reflector 230 (see FIG. 4) scatter the emitted light out of light guide 250 toward optical sheet 100(2). Light redirecting elements of optical sheet 100(2), such as the elliptical diffusers, conical diffusers and/or lenses discussed above (see FIGS. 2A through 2E) modify light 280 as it leaves optical sheet 100(2)'s outer surface, resulting for example in collimated, redirected and/or diffuse light leaving luminaire 200. The distributions and characteristics of the light redirecting elements create a 3D visual effect of depth and/or other patterns of light emission. An optional cover sheet or plate (e.g., a clear plastic or glass plate, not shown) may also be installed to protect the diffuser and other components.

Exemplary materials for light guide 250 and/or optical sheets 100 are light transmissive, and include plastics such as PMMA (polymethylmethacrylate), other acrylics, polycarbonates, polystyrene, thermoplastics, and/or blends of these plastics, elastomers such as silicone, and glasses. Optional reflector 230, when present, may be a separate component, or may be a reflective surface applied or adhered to a back side of the light guide 250.

With backside illumination, whether from light sources 240 and a light guide 250, or from a different backlight apparatus behind optical sheet 100, different portions of a 3D pattern can be configured to cause light 280 to come out at different angles (e.g., elliptically, conically, collimated or asymmetrically) for different areas of the pattern, these typically generate a visual impression of patterned areas of contrast. Furthermore, when a viewer changes viewing angle from the surface, the areas of contrast (e.g., bright vs dark areas) can change, because of the change in viewing angle in relationship to the local emitting angle. This changing contrast effect allows for areas of the pattern to change from dark to bright in relationship to each other and is strongly associated in the human mind with a 3D effect. That is, from experience in viewing similar changes in light with respect to change in viewing angle, a human viewer will generally assume that they are looking at a 3D surface, unless they take the time to look closely and figure out that the pattern is being emitted from a two-dimensional object. Alternatively, when the backlight apparatus is turned off, the luminaire surface is no longer emitting light, but ambient light can fall on the outer surface of optical sheet 100. In this case, the viewer still sees the reflection of this ambient light off of the surface; the reflected light is also affected by the optical microstructures in the reciprocal manner of the transmitted light, thus again providing surface patterns of contrast that change when the viewing angle changes. Because of this, in this case also, the surface will be perceived by a human viewer as 3D. The use of a reflector 230 behind a light guide, in edge-lit designs, can enhance the reflected light even when the luminaire is in the "off" state, enhancing the 3D impression.

FIG. 4A schematically illustrates, in a cross-sectional view, optical structures of optical subassembly 225(1) of FIG. 3, including for example one LED (or other) light source 240, optional reflector 230, light guide 250, and optical sheet 100(2) having a combination of prismatic lens and elliptical diffusers. Light source 240 emits light 280 into light guide 250, which substantially contains light 280 through total internal reflection, except when light 280 interacts with extraction features 255. When scattered out of the total internal condition, light 280 may exit light guide 250 directly (because it is scattered into an angle that exceeds the total internal reflection condition) or may reflect from reflector 230 before it passes back through, and exits, light guide 250. After leaving light guide 250 in direction O, light 280 passes through optical sheet 100(2) where it may be redirected by elliptical diffusers 112 (especially in transverse direction T), conical diffusers 116, prismatic lens structures 114, and/or others as described above.

FIG. 4B schematically illustrates, in a cross-sectional view, optical structures of an alternate optical subassembly 225(2), which includes one or more light sources 240, and optical sheet 100(2). Light sources 240 may be any single type or combination of light sources, e.g., LEDs, incandescent, fluorescent and/or other light emitters. Although multiple light sources 240 are shown in FIG. 4B, it is intended that any number of light sources 240 may be included. Light source(s) 240 emit light 280 directly toward optical sheet 100(2), where it may be redirected by elliptical diffusers 112 (especially in transverse direction T), conical diffusers 116, prismatic lens structures 114, and/or others as described above. Optical subassembly 225(2) may be useful for luminaires with different requirements than luminaire 200 (FIG. 3) due to cost, quality of light from specific light source(s) 240, or other criteria.

Figure 5:
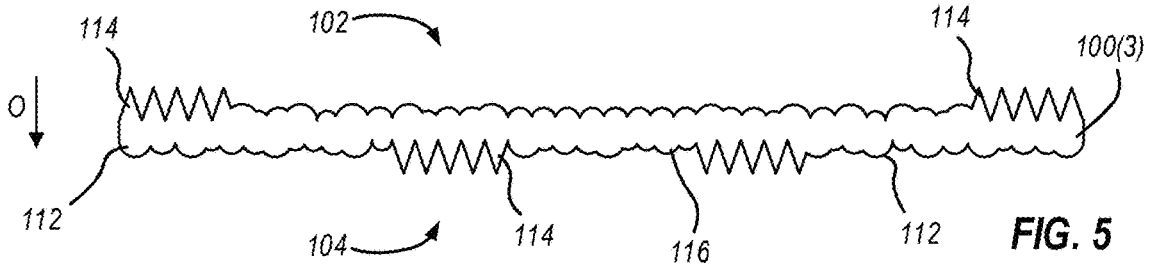
FIG. 5 schematically illustrates, in a cross-sectional view, an exemplary optical sheet having a combination of prismatic lenses and various diffusers on both an interior surface and an outer surface thereof, according to one or more embodiments.

FIG. 5 schematically illustrates, in a cross-sectional view, another exemplary optical sheet 100(3) that has a combination of prismatic lenses and various diffusers on both an interior surface 102 and an outer surface 104 thereof. In this exemplary embodiment, the top-to-bottom direction in the orientation of FIG. 5 is direction O. Interior side or surface 102 of optical sheet 100(3) is configured with prismatic lens structures 114 and opposing surface 104 is configured with diffusers, or a combination of diffusers and prismatic lenses. For example, the interior surface may be configured with prismatic lenses to produce collimated light from a light source, that is then diffused by the diffusers and/or lenses on the outer surface. The diffusion provided by the diffusers and/or lenses on the outer surface may be slight or severe, and may be omnidirectional (e.g., as provided by conical diffusers) or directional (e.g., as provided by elliptical diffusers, which diffuse light more in one direction than another). The pattern of light redirecting elements on surface 102 can be registered, during manufacture of optical sheet 100(3), to the pattern on surface 104 to provide specific light redirection effects.

Figure 6:
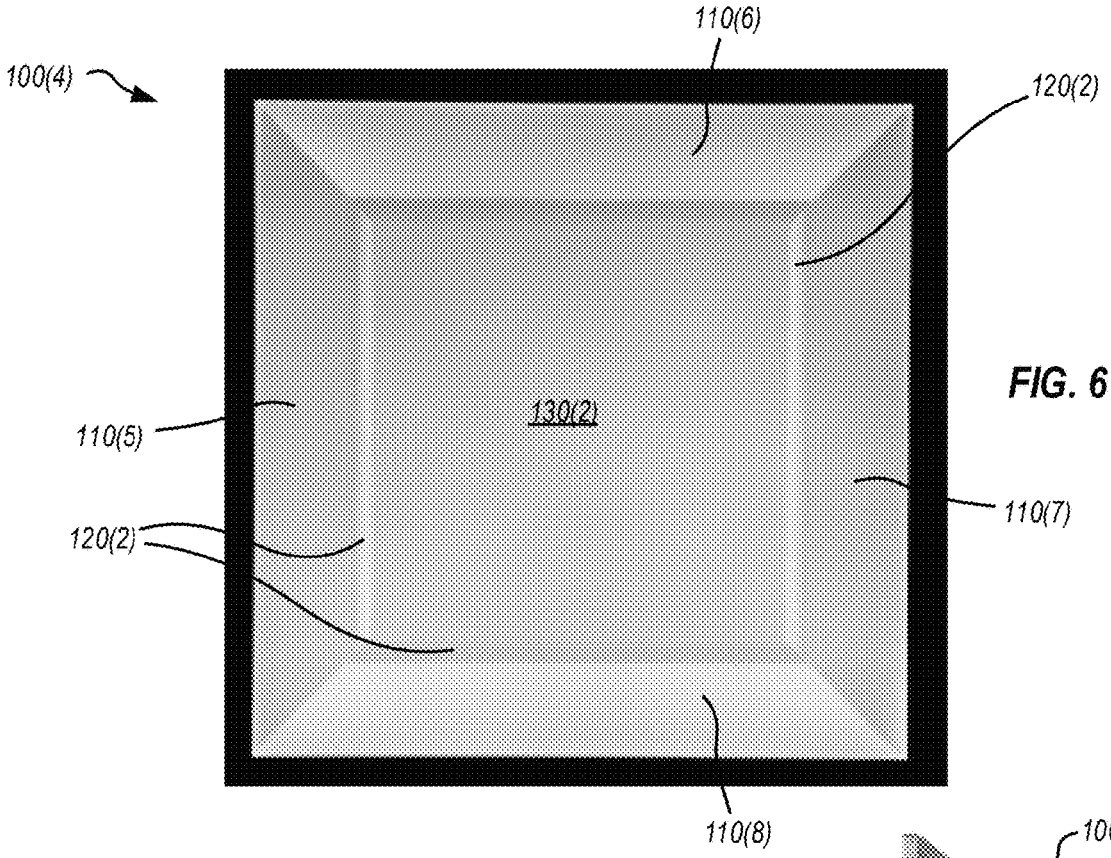
FIG. 6 illustrates, in a front view, an exemplary picture frame 3D optical sheet design, according to one or more embodiments.
Figure 7:
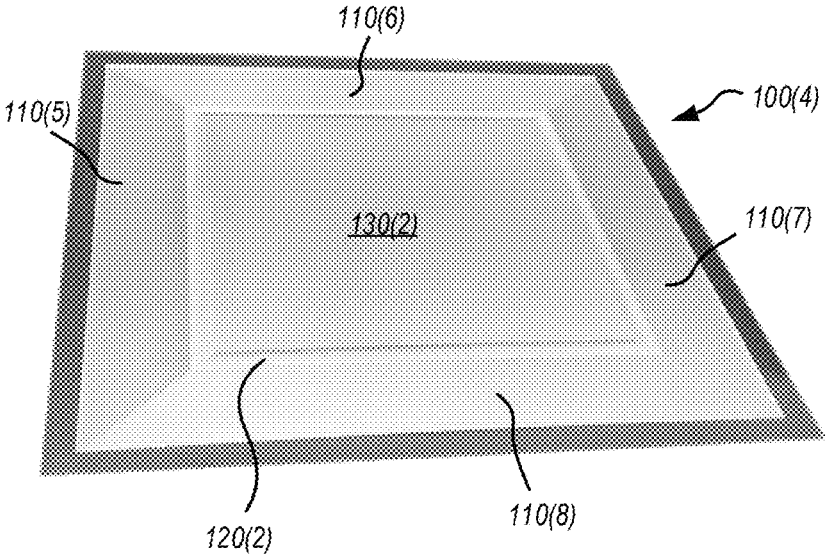
FIG. 7 illustrates, in a front perspective view, the exemplary picture frame 3D optical sheet design of FIG. 6.
Figure 8:
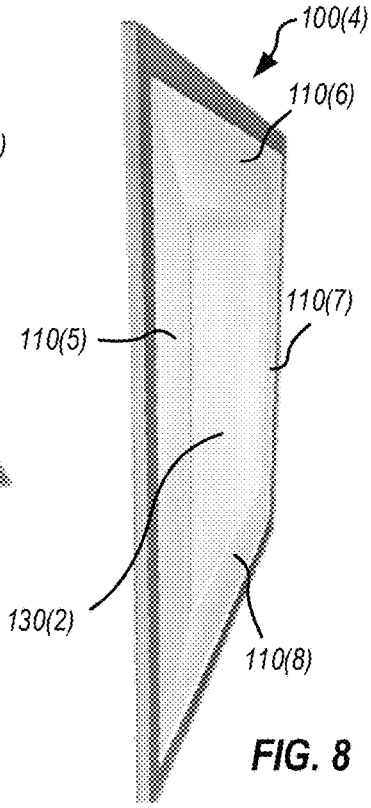
FIG. 8 illustrates, in a side perspective view, the exemplary picture frame 3D optical sheet design of FIG. 6.

FIG. 6 shows a front view of an exemplary optical sheet 100(4) that produces a 3D "picture frame" effect. FIG. 7 shows a front perspective view of optical sheet 100(4), and FIG. 8 shows a side perspective view of optical sheet 100(4). The FIGS. 7 and 8 views, in combination with that of FIG. 6, demonstrate that the optical sheet design is actually flat, even though the design has the visual effect of depth. The picture frame effect is achieved by having elliptical diffusers 112 in adjacent spatial regions 110(5), 110(6), 110(7) and 110(8) that resemble mitered frame sections, at different angular orientations with respect to one another. For example, in this embodiment, each spatial region 110 (any of 110(5), 110(6), 110(7), 110(8)) has elliptical diffuser 112 with predominant orientations that are rotated 90 degrees with respect to its adjacent spatial regions 110. This causes each spatial region 110 to form a contrast with the adjacent spatial region 110 from all viewing angles; at the same time, different ones of spatial regions 106 will be light or dark depending on viewing angle. As discussed above, spatial regions 110(5), 110(6), 110(7) and 110(8) may be said herein to form a "square" or an "outer square," despite those spatial regions not extending through the center of the square. In a central spatial region 130(2) (sometimes called a central square, or inner square, herein) conical diffusers 116 are used to give a uniform look over a wide viewing angle, but provide contrast to the outer spatial regions 110 as viewing angle changes. Between the outer square formed by spatial regions 110, and the inner square spatial region 130(2), is a spatial region 120(2) that includes a prismatic structure with varying prism angles. (Not all segments of spatial region 120(2) are labeled in FIGS. 6-8 for clarity of illustration.) In this embodiment, varying angles of prismatic lens structures 114 (see FIGS. 2A, 2D) across the width of spatial region 120(2) creates a linear Fresnel lens that creates the appearance of a concave or convex lens cylinder. The use of this type of Fresnel lens for spatial region 120(2) creates a visual impression of rounded depth and a bezel effect, adding further to the 3D appearance of the frame.

Figure 9:
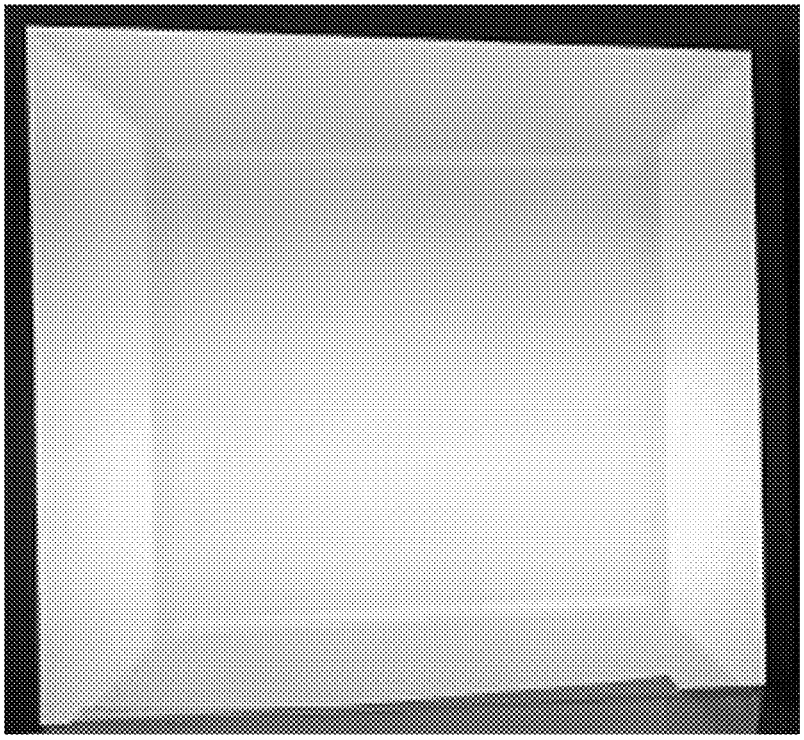
FIG. 9 shows a front view of an exemplary light assembly configured with a picture frame 3D optical sheet design without prismatic accent, according to one or more embodiments.
Figure 10:
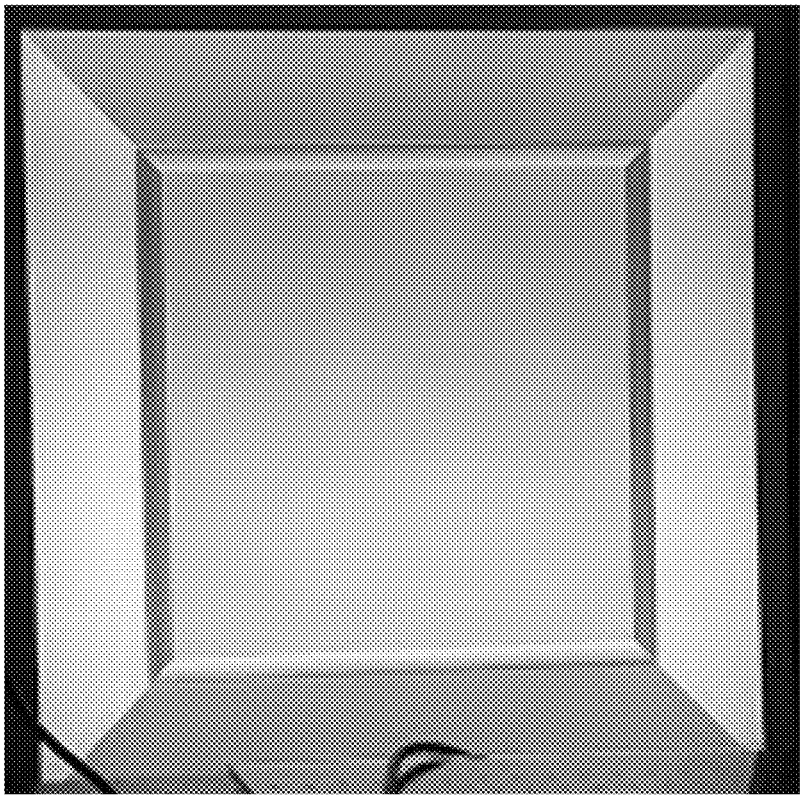
FIG. 10 shows a front view of an exemplary light assembly configured with a picture frame 3D optical sheet design with prismatic accent, according to one or more embodiments.

FIGS. 9 and 10 are photographs of exemplary optical sheets 100(5), 100(6) respectively, that illustrate the visual difference of including or not including a prismatic lens region between a central region and outer spatial regions. Optical sheet 100(5), shown in FIG. 9, does not have a prismatic lens spatial region between the inner and outer frames, and consequently has a relatively "flat" visual appearance. Optical sheet 100(6), shown in FIG. 10, has a prismatic lens perimeter between the inner and outer frames, providing a visual appearance that much more strongly suggests a 3D surface, despite the fact that the optical sheet is essentially flat (that is, flat except for <1000 micron surface features). For example, the visual appearance provided by the combination of features discussed above may provide a visual impression of portions of the optical sheet being at angles, with respect to one another, in or out of the plane of the optical sheet. These angles, subtended over the length of the corresponding shapes, will be interpreted by the mind of the viewer as 3D surface relief on the order of the size of the shapes. That is, when the shapes are inches wide or long, the 3D surface relief may appear to be on the order of inches; in larger installations, when the shapes are feet wide or long, the 3D surface relief may appear to be on the order of feet. The 3D surface relief may be perceived as "depth," e.g., appearing to recede from the plane of the optical sheet, or "height," e.g., appearing to extend toward the viewer from the plane of the optical sheet.

The prismatic elements can be Fresnel or straight prismatic structures. In this sense, Fresnel denotes having changing prism angles to create a lens with a diameter/focal point, while straight prismatic structures may be linear prisms with a repeating fixed angle. Both the Fresnel and prismatic elements can be used to create greater contrast when placed next to diffuser structures. Fresnel structures can impart a round or curved image, based on the associated focal point of the lens. Prismatic elements can cause collimation and/or redirection of the transmitted light into particular angles, and provide enhanced contrast change vs viewing angle. Asymmetric prisms can cause asymmetric bending of the transmitted light and asymmetric contrast. Contrasting prismatic elements with diffuser elements can be used to create a "forced perspective," where the design itself creates a 3D impression. A basic example is the drawing of a train track moving out to the horizon using two lines; by varying angles of the design elements, a sense of depth can be created. The prismatic structures or oriented diffuser structures can be overlaid on a pattern to create a forced perspective, and ultimately enhance the resulting 3D look.

Figure 11:
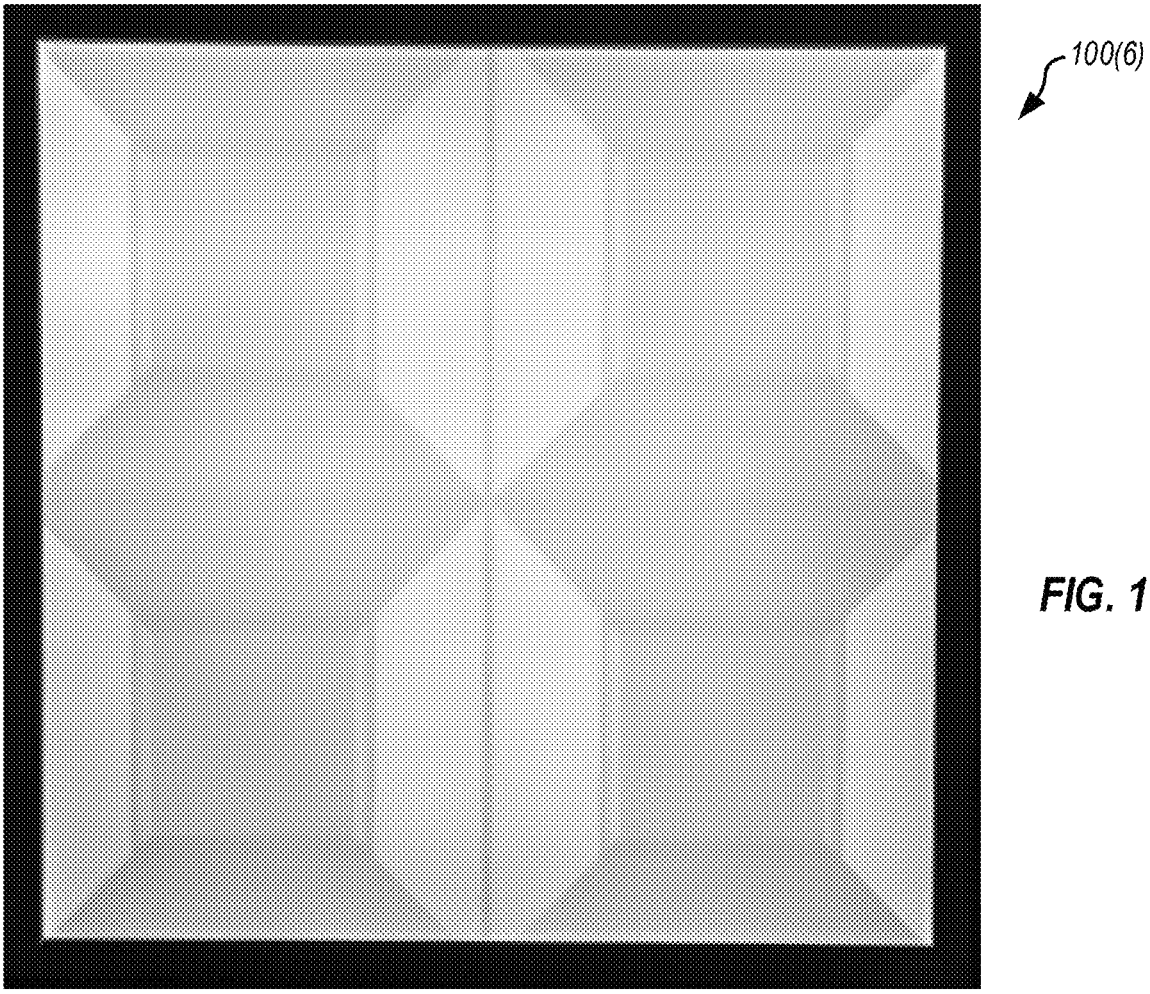
FIG. 11 illustrates, in a front view, an exemplary light assembly configured with a multi-panel frame 3D optical sheet design, according to one or more embodiments.
Figure 12:
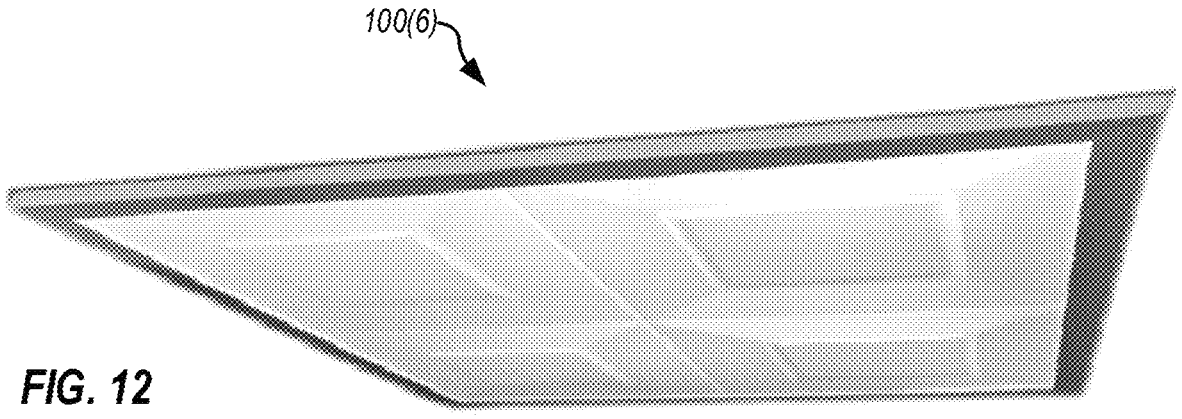
FIG. 12 illustrates, in a side perspective view, the exemplary light assembly, configured with a multi-panel frame 3D optical sheet design, of FIG. 11.

FIGS. 11 and 12 illustrate a luminaire having an exemplary multi-panel frame 3D optical sheet 100(6) that provides a visual impression of four 3D panels, each of which has a picture frame design. The fixture includes an edge-lit light guide design constructed similarly to luminaire 200, as illustrated in FIGS. 3 and 4A. The "quad" design of FIGS. 11 and 12 takes the picture frame from FIG. 9 and repeats it in each of 4 quadrants; that is, in a two row, two column layout. Thus, the outer spatial regions of each picture frame include elliptical diffusers, with their predominant spatial orientations rotated in adjacent spatial regions around each frame, and a central region with conical diffusers, again as illustrated in FIGS. 3 and 4A. An optional prismatic lens perimeter is included between the inner square and outer squares of each picture frame.

Figure 13:
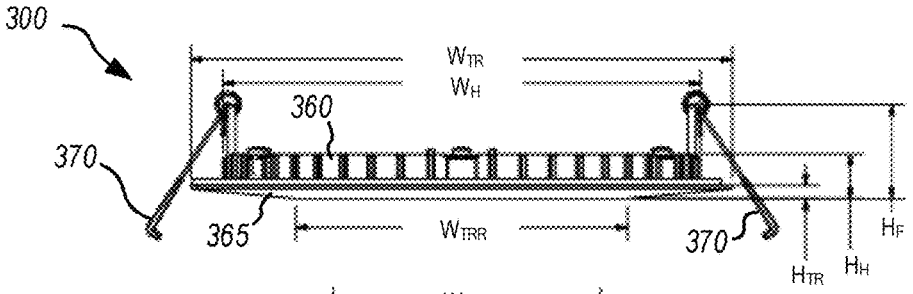
FIG. 13 is a schematic, side elevation of a luminaire that includes a simplified, recessed square frame design, having a 3D appearance provided by an optical sheet, according to one or more embodiments.
Figure 14:
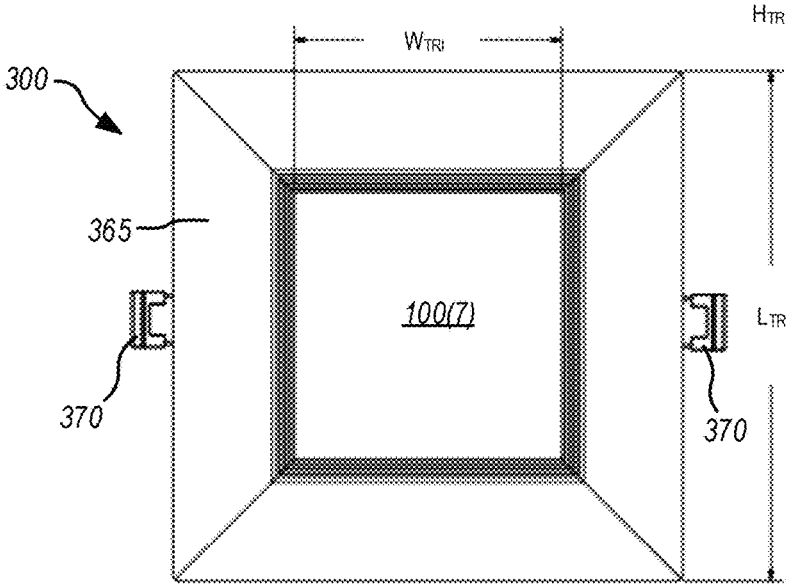
FIG. 14 is a schematic, bottom (e.g., upwardly-looking) plan view of the luminaire of FIG. 13.
Figure 15:
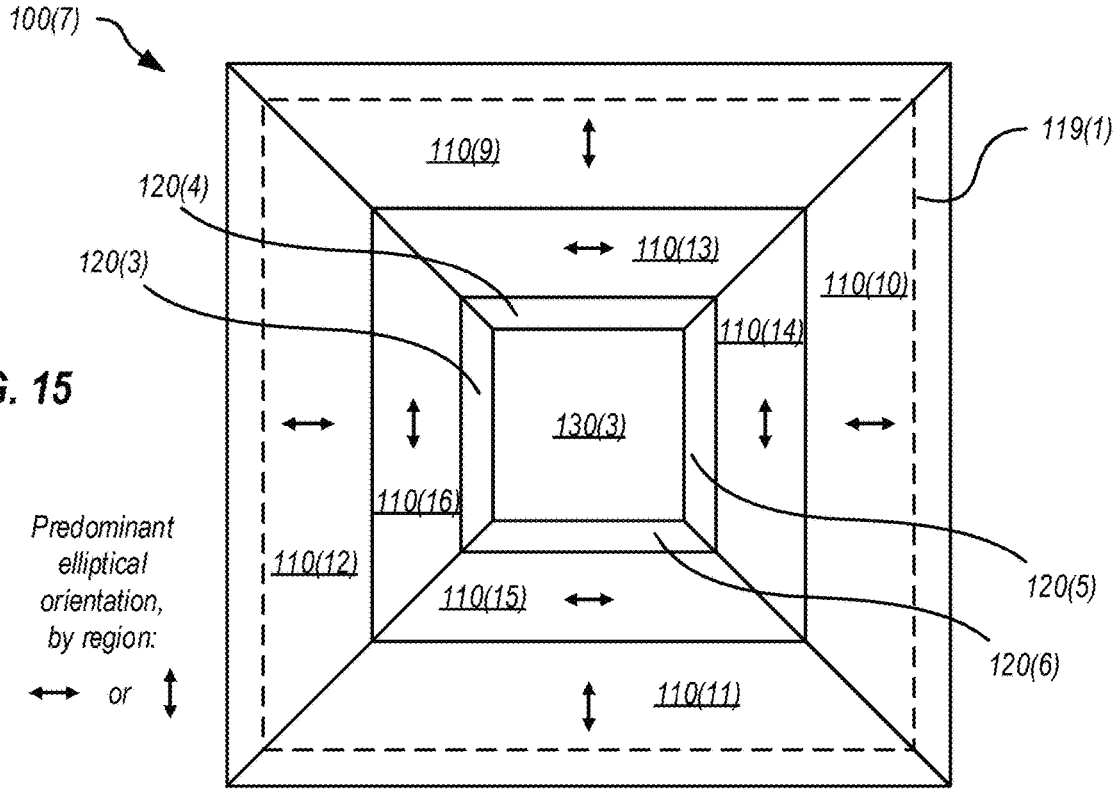
FIG. 15 is a schematic illustration of the optical sheet that provides the 3D appearance for the square frame design of the luminaire of FIG. 13, according to one or more embodiments.

FIGS. 13, 14 and 15 schematically illustrate a luminaire 300 that includes a relatively simple, recessed, 3D square frame design provided by an optical sheet 100(7). FIG. 13 is a side elevation of the luminaire; FIG. 14 is a bottom (e.g., upwardly-looking) plan view of luminaire 300 at the same scale as FIG. 13; and FIG. 15 is a schematic illustration of the optical sheet within luminaire 300, enlarged relative to the views of FIGS. 13 and 14.

In FIG. 13, luminaire 300 is shown as having a housing 360 and a trim ring 365. Certain dimensions of luminaire 300 are indicated as a trim ring width $W_{TR}$, a housing width $W_H$, a trim ring ridge width $W_{TRR}$, a fixture total height $H_F$, a housing height $H_H$, and a trim ring height $H_{TR}$. In a particular embodiment, luminaire 300 can be mounted within a 6 inch square recess or hole in a ceiling material (e.g., drywall or ceiling tile). In this embodiment, $W_{TR}$ is about 6.7 inches (to provide coverage around the bottom of the hole or recess in which luminaire 300 mounts); $W_H$ is about 5.9 inches (to fit within the 6 inch square recess or hole); $W_{TRR}$ is about 4.1 inches; $H_F$ is about 1.2 inches, $H_H$ is about 0.5 inches; and $H_{TR}$ is about 0.2 inches. Housing 360 has width $W_H$ and height $H_H$, and contains the lighting system of luminaire 300 (e.g., as illustrated in FIGS. 3-5). Optional, spring loaded arms 370 may be coupled with housing 360 in order to support it within a ceiling. Trim ring 365 is added to the bottom of housing 360 in order to provide a finished look (the hole or recess in the ceiling will usually be a bit larger than housing 360, and trim ring 365 will cover the gap between the ceiling material edge and housing 360).

FIG. 14 indicates an trim ring inner opening width as $W_{TRI}$, and a trim ring length $L_{TR}$ that, in the illustrated embodiment, is equal to $W_{TR}$ (that is, luminaire 300 is square in plan view, except for spring loaded arms 370, which will be hidden above the ceiling material). As discussed above, the square shape and fourfold symmetry of luminaire 300 and optical sheet 100(7) are exemplary only. Similar luminaires are contemplated which may be rectangular in plan view, with optical sheets having asymmetric shapes, forming for example borders that have different top and bottom widths than left and right widths, and the like.

FIG. 15 illustrates various features of the optical sheet 100(7) of luminaire 300, that provide luminaire 300 with an appearance of 3D depth from beneath, although luminaire 300 is relatively flat and optical sheet 100(7) is very flat. The design provided by the illustrated optical sheet 100(7) is that of a "picture frame" similar to those shown in FIGS. 1, 6-8, 10, and 11-12, albeit with different proportions, and the single picture frame being one of the four frames of the FIG. 11, 12 design. A central spatial region (or central/inner rectangle or square) 130(3) is populated with conical diffusers 116 (see FIGS. 2A and 2C) that may provide a dispersion cone of about 30 degrees to light passing therethrough. A small frame-like area formed of spatial regions 120(3), 120(4), 120(5), and 120(6) surrounding spatial region 130(3) may be present to provide a visual boundary between inner square spatial region 130(3) and the outer spatial regions having elliptical diffusers, that are discussed below. Spatial regions 120(3), 120(4), 120(5), and 120(6) surrounding spatial region 130(3) may include prismatic features to accent this visual boundary, similar to the case illustrated in FIG. 10. Two successively larger frame areas, composed of spatial regions 110(9), 110(10), 110(11), 110(12), 110(13), 110(14), 110(14) and 110(16), located outside of spatial region 130(3) and the frame-like area, include elliptical diffusers 112 (not labeled in FIG. 15, see FIGS. 2A and 2C). The elliptical diffusers 112 in these regions alternate in predominant orientation, both in sequence going around optical sheet 100(7), and from inward to outward relative to the edges of optical sheet 100(7) (for example, orientation of elliptical diffusers 112 is top-to-bottom in spatial region 110(16), but left-to-right in immediately adjacent spatial regions 110(12), 110(13) and 110(15), as shown). Orientation of the diffusers within each area is shown by a double-headed arrow in FIG. 15. The changes in predominant orientation cause light redirection by optical sheet 100(7) to be significantly different in adjacent regions. This alternating orientation provides a visual impression of 3D depth. The effect also applies, to some degree, to light reflected from optical sheet 100(7) when luminaire 300 is turned off. That is, when ambient room light reflects from the optical sheet the directions of the elliptical diffusers will generate a different glint from one another, and that glint will vary with respect to a viewer's position, so as to generate a visual impression of 3D depth even when the luminaire is turned off. A rectangular "bleed line" 119(1) is also designated, this is not a physical feature but corresponds to a boundary outside of which optical sheet 100(7) is located behind the inner portion of trim ring 365, when installed. That is, bleed line 119(1) has both width and height equal to $W_{TRI}$, indicated in FIGS. 13 and 14.

Figure 16:
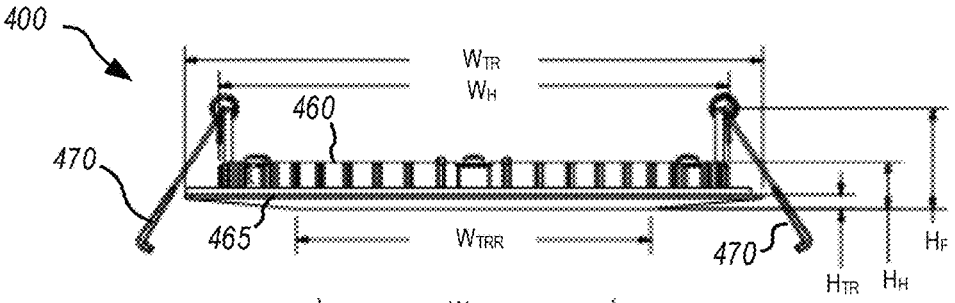
FIG. 16 is a schematic, side elevation of a luminaire that includes a more complex, recessed square frame design, having a 3D appearance provided by an optical sheet, according to one or more embodiments.
Figure 17:
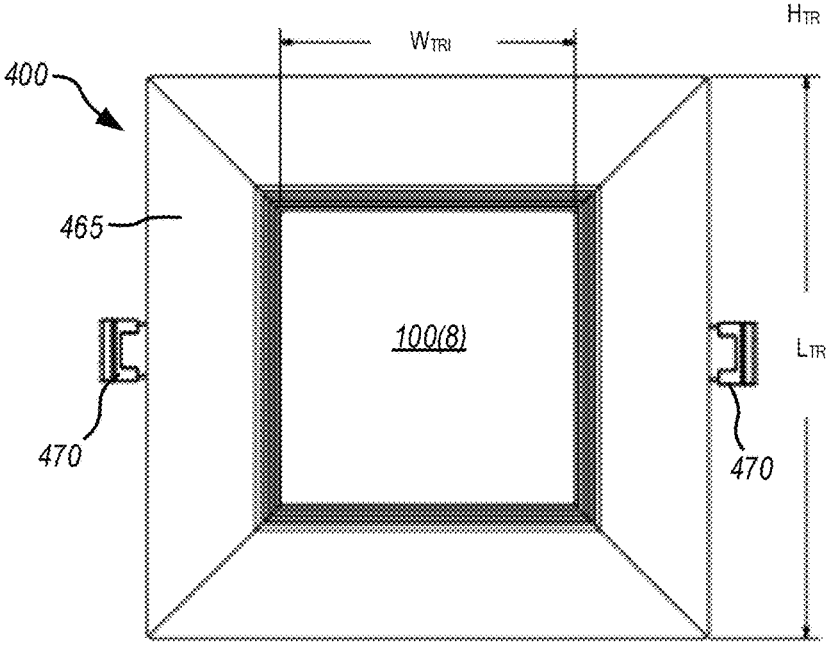
FIG. 17 is a schematic, bottom (e.g., upwardly-looking) plan view of the luminaire of FIG. 16.
Figure 18:
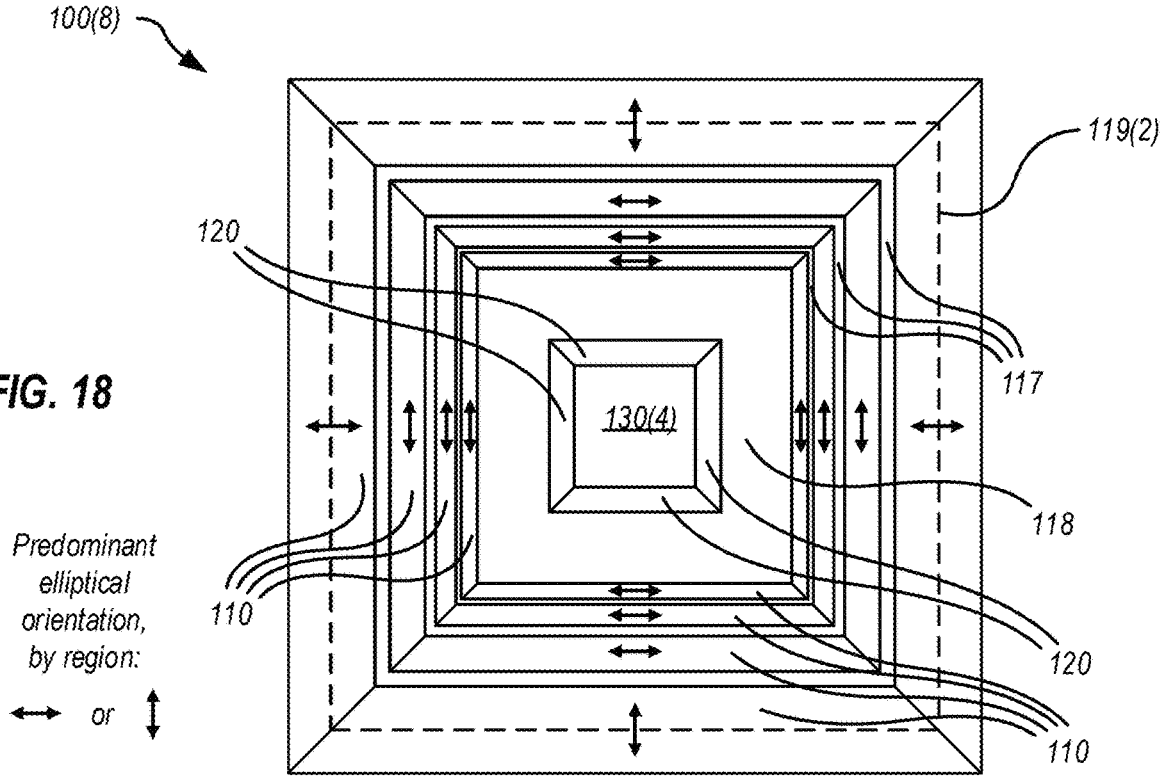
FIG. 18 is a schematic illustration of the optical sheet that provides the 3D appearance for the square frame design of the luminaire of FIG. 16, according to one or more embodiments.

FIGS. 16, 17 and 18 schematically illustrate a luminaire 400 that includes a more complex square frame design (than that illustrated in FIGS. 13, 14, 15) which is provided by an optical sheet 100(8). FIG. 16 is a side elevation of luminaire 400; FIG. 17 is a bottom (e.g., upwardly-looking) plan view of luminaire 400 at the same scale as FIG. 16; and FIG. 18 is a schematic illustration of the optical sheet within luminaire 400, enlarged relative to the views of FIGS. 16 and 17. The mechanical components of luminaire 400 illustrated in FIGS. 16, 17 and 18 are identical to those illustrated in FIGS. 13, 14 and 15; only the optical sheet used with luminaire 400 is different. Therefore dimensions $W_{TR}$, $W_H$, $W_{TRR}$, $H_F$, $H_H$, $H_{TR}$, $W_{TRI}$, and $L_{TR}$ have the same meanings for luminaire 400 as for luminaire 300 (FIG. 13, 14, 15).

Optical sheet 100(8) schematically illustrated in FIG. 18 is similar to optical sheet 100(7), FIG. 15, with some key differences. Optical sheet 100(8) remains square, with an innermost spatial region 130(4) providing 30 degree diffusion, and an outer area that is divided into mitered quadrants that form a frame region. The innermost spatial region 130(4) is surrounded by a narrow frame-like area formed by several spatial regions 120, which may include prismatic features to accent this visual boundary. (Note, in FIG. 18, the many individual elements of similar type are not necessarily labeled with numerals in parentheses, for clarity of illustration.) The outermost area has spatial regions 110 with elliptical diffusers. Elliptical orientation of each quadrant is again labeled in FIG. 18 with double headed arrows, and orientation of adjacent spatial regions in the outermost areas are rotated by ninety degrees relative to their neighbors at each corner. An unmarked bleed line 119(2) is also shown within the outermost area, indicating the area that will be visible from below within the trim ring (e.g., having dimensions of $W_{TRI}$ in each direction).

However, in optical sheet 100(8), the outermost area spatial regions 110 are narrower than their counterparts in optical sheet 100(7), and the large area between the outermost area and the small, frame-like area is divided into several mitered bands (e.g., frame regions) formed of additional spatial regions 110 with elliptical diffusers, separated by small continuous bands 117 with conical diffusers. Each spatial region of the several mitered bands has the same elliptical orientation as those segments that run parallel to it, and in each quadrant of the frame layout, this orientation is rotated 90 degrees with respect to the elliptical orientation of the outermost spatial region 110 of that quadrant. There is also a wide, conical diffuser spatial region 118 between the innermost mitered band and the small, frame-like area.

Viewed from below, the layout of optical sheet 100(8) creates a 3D impression of "height" extending from the surface of luminaire 400 at the level of the trim ring 465, receding "upwards" through the several mitered bands, until it reaches a "ceiling" level at conical diffuser spatial region 118 between the innermost mitered band and the small, frame-like area (spatial regions 120, 130(4)). The small, frame-like area and the 30 degree conical diffuser area at the center then provide the appearance of a feature that is either suspended "below" the "ceiling" level of spatial region 118, or extends further "above" it. The words in quotation marks here signify that these appearances are only illusory, since the optical sheet that generates the 3D appearance is in fact flat (give or take normal manufacturing tolerances and the height of the diffusers themselves, <=1000 microns from a reference height of the sheet).

Figure 19:
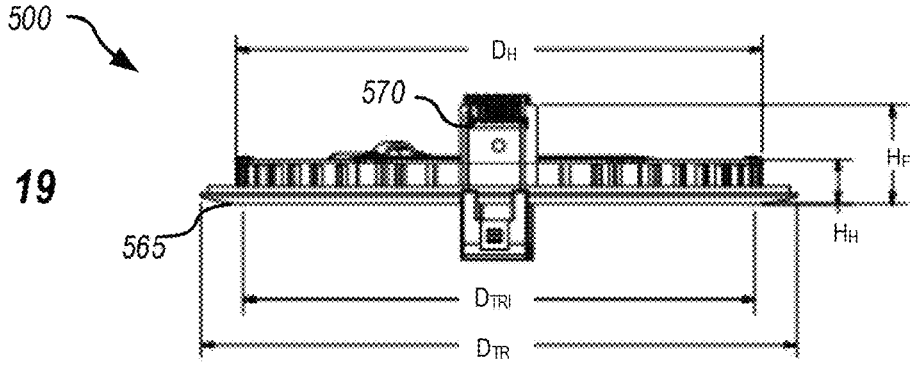
FIG. 19 is a schematic, side elevation of a luminaire that includes a simplified, circular design, having a 3D appearance provided by an optical sheet, according to one or more embodiments.
Figure 20:
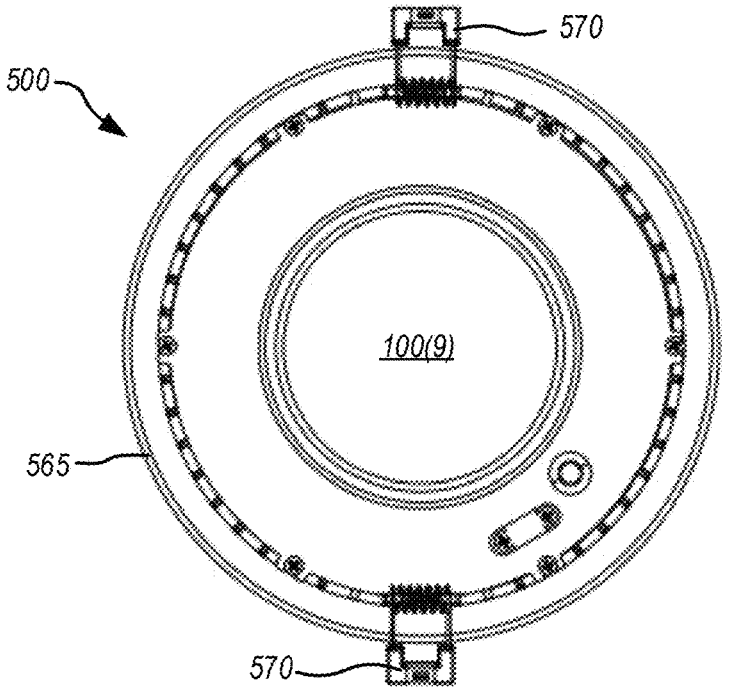
FIG. 20 is a schematic, top (e.g., downwardly-looking) plan view of the luminaire of FIG. 19.
Figure 21:
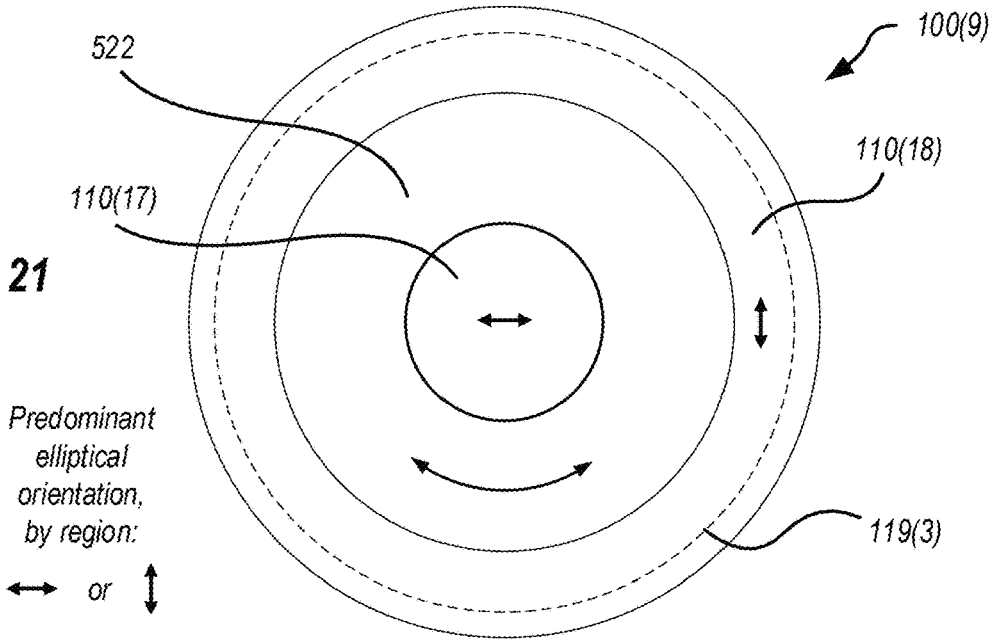
FIG. 21 is a schematic illustration of the optical sheet that provides the 3D appearance for the circular design of the luminaire of FIG. 19, according to one or more embodiments.

FIGS. 19, 20 and 21 schematically illustrate a luminaire 500 that includes a simplified circular design provided by an optical sheet 100(9). FIG. 19 is a side elevation of luminaire 500; FIG. 20 is a top (e.g., downwardly-looking) plan view of luminaire 500 at the same scale as FIG. 19; and FIG. 21 is a schematic illustration of optical sheet 100(9) within luminaire 500, enlarged relative to the views of FIGS. 19 and 20.

FIG. 19 indicates certain dimensions of luminaire 500 as a trim ring diameter $D_{TR}$, a housing diameter $D_H$, a trim ring inner opening width as arm, a fixture total height $H_F$, and a housing height $H_H$. In a particular embodiment, luminaire 500 can be mounted within a 6 inch round recess or hole in a ceiling material (e.g., drywall or ceiling tile). In this embodiment, $D_{TR}$ is about 6.7 inches (to provide coverage around the bottom of the hole or recess in which luminaire 500 mounts); $D_H$ is about 5.9 inches (to fit within the 6 inch square recess or hole); $H_F$ is about 1.1 inches; and $H_H$ is about 0.5 inches. A housing of the luminaire, having diameter $D_H$ and height $H_H$, contains the lighting system of luminaire 500 (e.g., as illustrated in FIGS. 3-5, but in a round format). Spring loaded arms may be coupled with this housing in order to support it within the ceiling material. Luminaire 500 is round in the bottom plan view of FIG. 20, except for the spring loaded arms, which will be hidden above the ceiling material. A trim ring 565 is added to the bottom of the housing in order to provide a finished look (the hole or recess will usually be a bit larger than the housing, and the trim ring will cover the gap between the ceiling material edge and the housing).

FIG. 21 illustrates various features of the optical sheet 100(9) of luminaire 500, that provide luminaire 500 with an appearance of 3D depth from beneath, although luminaire 500 is relatively flat and optical sheet 100(9) is very flat. The design provided by optical sheet 100(9) is that of a "donut" that appears to have a receding surface at different diameters within the viewable area. An inner spatial region 110 is populated with elliptical diffusers that are oriented in a predominant direction, shown as horizontal in the orientation of FIG. 21. A "donut lens" 522 surrounds the inner region. Donut lens 522 is a radial prismatic element having varying prism angles, in a radial band with a fixed width (i.e., an annulus with fixed inner and outer radius). This provides a lens effect in a "donut" shape, as opposed to a circular Fresnel lens that has only a single radius. An outer area, located radially outward of the inner area and the donut lens, includes elliptical diffusers that are oriented at a 90 degree angle to those of the inner area. This provides a visual impression of 3D depth. The effect also applies, to some degree, to light reflected from optical sheet 100(9). That is, when ambient room light reflects from optical sheet 100(9), the directions of the elliptical diffusers will generate a different glint from one another, and that glint will vary with respect to a viewer's position, so as to generate a visual impression of 3D depth even when luminaire 500 is turned off, that is, the light redirecting elements provide effects in both transmitted and reflected light. A round "bleed line" 119(3) is designated, this is not a physical feature but corresponds to a boundary outside of which optical sheet 100(9) is located behind the inner portion of the trim ring 565, when installed. That is, bleed line 119(3) has diameter equal to $D_{TRI}$, as indicated in FIG. 19.

Figure 22:
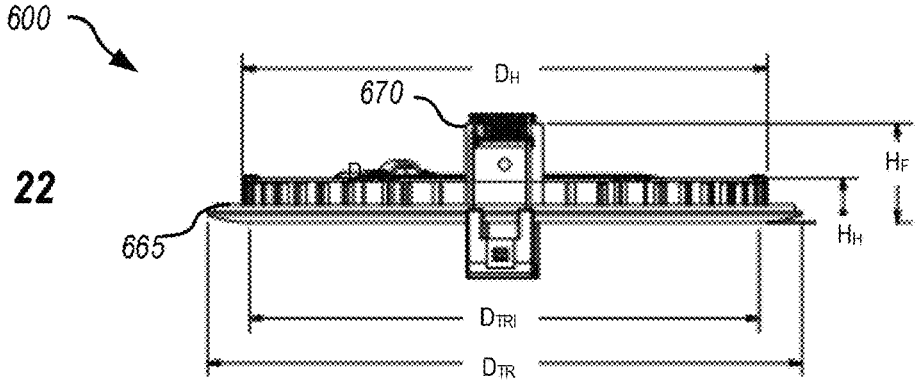
FIG. 22 is a schematic, side elevation of a luminaire that includes a more complex circular design, having a 3D appearance provided by an optical sheet, according to one or more embodiments.
Figure 23:
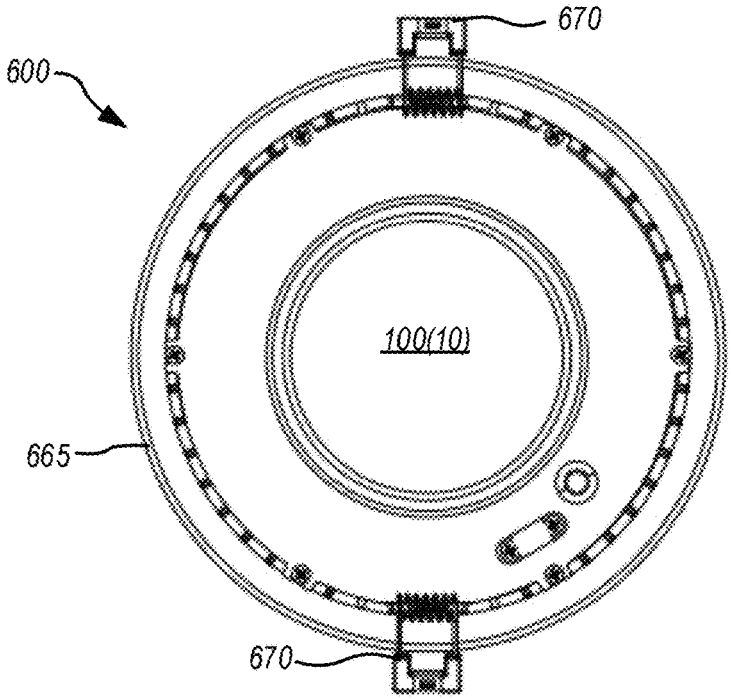
FIG. 23 is a schematic, top (e.g., downwardly-looking) plan view of the luminaire of FIG. 22.
Figure 24:
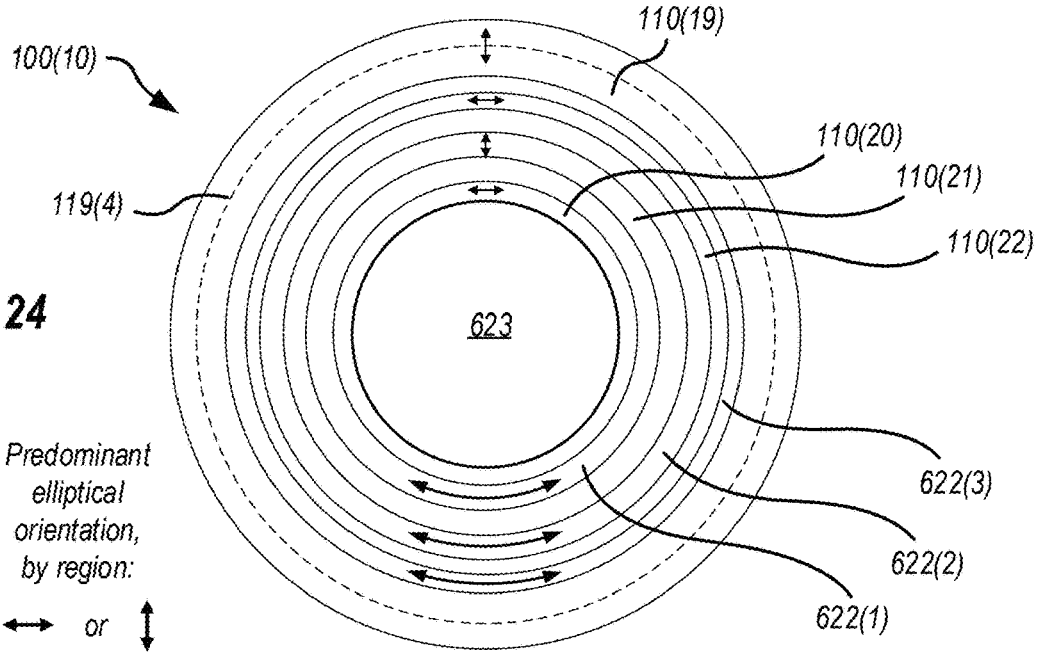
FIG. 24 is a schematic illustration of the optical sheet that provides the 3D appearance for the circular design of the luminaire of FIG. 22, according to one or more embodiments.

FIGS. 22, 23 and 24 schematically illustrate a luminaire 600 that includes a more complex round frame design (than that illustrated in FIGS. 19, 20, 21) which is provided by an optical sheet 100(10). FIG. 22 is a side elevation of luminaire 600; FIG. 23 is a top (e.g., downwardly-looking) plan view of luminaire 600 at the same scale as FIG. 22; and FIG. 24 is a schematic illustration of optical sheet 100(10) within luminaire 600, enlarged relative to the views of FIGS. 22 and 23. The mechanical components of luminaire 600 illustrated in FIGS. 22, 23 and 24 are identical to those illustrated in FIGS. 19, 20 and 21; only optical sheet 100(10) used with luminaire 600 is different. Therefore dimensions $D_{TR}$, $D_H$, $D_{TRI}$, $H_H$, and $H_F$ have the same meanings for luminaire 600 as for luminaire 500.

Optical sheet 100(10), as schematically illustrated in FIG. 24, is similar to optical sheet 100(9), FIG. 21, with some key differences. Optical sheet 100(10) remains round, with an outermost spatial region 110(19) having elliptical diffusers, and within spatial region 110(19), an unmarked bleed line 119(4), indicating the area that will be visible from below, within the trim ring 665 (e.g., having a diameter of arm). However, in FIG. 24, the innermost area includes a central region 623 formed as a Fresnel lens. Central region 623 has a focal distance that is great enough that it does not focus light from luminaire 600 that projects through it, since the light source of luminaire 600 is an area source that is too close to the surface, but Fresnel lens 623 may give optical sheet 100(10) an either convex or concave depth appearance. For example, a Fresnel lens 623 with a 2" focal point may appear to be a 2" deep or proud lens, whereas a 4" focal point Fresnel lens 623 will seem to have less depth when cut down to a 2 inch diameter. Between Fresnel lens 623 and spatial region 110(19) are annular spatial regions 110(20), 110(21) and 110(22) of elliptical diffusers, with the elliptical orientation of each annulus rotated by ninety degrees relative to its neighbors, and donut lens sections 622(1), 622(2), 622(3) between each pair of elliptical diffuser spatial regions 110.

It will be appreciated by those skilled in the art that the widths and lengths described above can be modified to provide differently sized luminaires, but the heights need not scale with the widths, due to the use of light pipe and optical sheet technology described above. Thus, luminaires that are very large in area can be made with similar heights as those described above, but much larger widths/lengths/diameters.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A luminaire comprising:

a. a housing that defines a light output aperture;

b. a backlight apparatus that emits light toward the light output aperture; and c. an optical sheet of a light transmissive material disposed adjacent the backlight apparatus in a light output direction, the optical sheet comprising a first surface more proximate the backlight apparatus and an opposing second surface more proximate the light output aperture, wherein the second surface is substantially flat and wherein at least one of the first surface or the second surface comprises a first region and second region adjacent the first region, wherein:

the first region comprises first light redirecting elements oriented in a first orientation;

the second region comprises second light redirecting elements oriented in a second orientation; and at least one of:

the first light redirecting elements are of a type different from the second light redirecting elements; or the first orientation is different from the second orientation, wherein the optical sheet is adapted to modify the light emitted from the backlight apparatus to impart an impression of depth between the first region and the second region such that at least a portion of the second surface of the optical sheet appears three-dimensional despite being substantially flat.

2. The luminaire of claim 1, wherein at least some of the first light redirecting elements or the second light redirecting elements comprise elliptical structures, each extending in an axial direction.

3. The luminaire of claim 2, wherein at least some of the elliptical structures spread light passing therethrough less than ten degrees in the axial direction of the elliptical structure and at least twenty degrees in a direction transverse to the axial direction of the elliptical structure.

4. The luminaire of claim 2, wherein at least some of the first light redirecting elements and the second light redirecting elements comprise elliptical structures.

5. The luminaire of claim 4, wherein the first orientation is substantially parallel to the axial direction of the elliptical structures of the first light redirecting elements, wherein the second orientation is substantially parallel to the axial direction of the elliptical structures of the second light redirecting elements, and wherein the first orientation is different from the second orientation.

6. The luminaire of claim 5, wherein the first orientation is substantially perpendicular to the second orientation.

7. The luminaire of claim 1, wherein at least some of the first light redirecting elements or the second light redirecting elements comprise conical structures.

8. The luminaire of claim 7, wherein at least some of the conical structures spread light passing therethrough in a cone that subtends an angle of twenty to forty degrees.

9. The luminaire of claim 1, wherein at least one of the first region or the second region forms a non-linear shape.

10. The luminaire of claim 1, wherein the at least one of the first surface or the second surface further comprises a third region adjacent the second region such that the second region connects the first region and the third region and further comprises a fourth region adjacent the first region and the third region such that the fourth region connects the first region and the third region, wherein the first region, the second region, the third region, and the fourth region collectively frame a fifth region having a rectangular shape, and further wherein:

the first orientation is different from the second orientation;

the third region comprises third light redirecting elements oriented in a third orientation that is substantially parallel to the first orientation; and the fourth region comprises fourth light redirecting elements oriented in a fourth orientation that is substantially parallel to the second orientation.

11. The luminaire of claim 10, wherein each of the first and third orientations are substantially perpendicular to each of the second and fourth orientations.

12. The luminaire of claim 10, wherein at least some of the first light redirecting elements, the second light redirecting elements, the third light redirecting elements, and the fourth light redirecting elements comprise elliptical structures.

13. The luminaire of claim 10, wherein the fifth region comprises at least one type of optical microstructure selected from the group consisting of Fresnel lenses, v-groove lenses, v-cut lenses, pyramidal lenses, lenticular lenses, donut lenses and conical structures.

14. The luminaire of claim 13, wherein the at least one type of optical microstructure of the fifth region comprises conical structures.

15. The luminaire of claim 1, wherein the backlight apparatus comprises:

a plurality of light-emitting diodes (LEDs) disposed within the housing, wherein the LEDs are configured to emit the light; and a planar light guide disposed such that at least one edge of the planar light guide is capable of receiving the light from the LEDs, distributing the light within the planar light guide, and distributing the light toward the optical sheet.

16. The luminaire of claim 15, wherein the backlight apparatus further comprises a reflector disposed on a side of the planar light guide distal the light output direction, wherein the reflector is configured to reflect back toward the light output direction a portion of the light that is scattered by the planar light guide away from the light output direction.

17. A luminaire comprising:

a housing that defines a light output aperture;

a backlight apparatus that emits light toward the light output aperture; and an optical sheet of a light transmissive material, disposed adjacent the backlight apparatus in a light output direction, such that the light is modified by the optical sheet before leaving the light output aperture, the optical sheet forming a first surface and an opposite second surface, and wherein at least one of the first surface or the second surface of the optical sheet comprises:

a first spatial region that includes first light redirecting elements extending predominantly in a first axial direction, a second spatial region that includes second light redirecting elements extending predominantly in a second axial direction that is different from the first axial direction, wherein at least some of the first light redirecting elements and the second light redirecting elements comprise elliptical structures.

18. A luminaire comprising:

a housing that defines a light output aperture;

a backlight apparatus that emits light toward the light output aperture; and an optical sheet of a light transmissive material, disposed adjacent the backlight apparatus in a light output direction, such that the light is modified by the optical sheet before leaving the light output aperture, the optical sheet forming a first surface and an opposite second surface, and wherein at least one of the first surface or the second surface of the optical sheet comprises:

a first spatial region that includes first light redirecting elements extending predominantly in a first axial direction, a second spatial region that includes second light redirecting elements extending predominantly in a second axial direction that is different from the first axial direction, wherein the first axial direction is substantially perpendicular to the second axial direction.

* * * * *